US008653370B2

(12) United States Patent
Johnson et al.

(10) Patent No.: US 8,653,370 B2
(45) **Date of Patent: *Feb. 18, 2014**

(54) CABLE AND METHOD OF MAKING THE SAME

(75) Inventors: Douglas E. Johnson, Minneapolis, MN (US); Colin McCullough, Chanhassen, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 284 days.

This patent is subject to a terminal disclaimer.

(21) Appl. No.: 11/318,368

(22) Filed: Dec. 23, 2005

(65) Prior Publication Data

US 2006/0102378 A1 May 18, 2006

Related U.S. Application Data

(63) Continuation of application No. 10/870,401, filed on Jun. 17, 2004, now abandoned.

(51) Int. Cl.
*H01B 9/02* (2006.01)

(52) U.S. Cl.
USPC ..... 174/108

(58) Field of Classification Search
USPC ..... 174/108, 113 R, 119 R, 128.1, 128.2, 174/126.2
See application file for complete search history.

(56) References Cited

U.S. PATENT DOCUMENTS

| | | | |
|---|---|---|---|
| 3,429,722 | A | 2/1969 | Economy et al. |
| 3,567,407 | A | 3/1971 | Yoblin |
| 3,706,216 | A | 12/1972 | Weingarten |
| 3,795,524 | A | 3/1974 | Sowman |
| 4,047,965 | A | 9/1977 | Karst et al. |
| 4,649,060 | A | 3/1987 | Ishikawa et al. |
| 4,779,563 | A | 10/1988 | Ishikawa et al. |
| 4,843,696 | A | 7/1989 | Gentry et al. |
| 4,877,643 | A | 10/1989 | Ishikawa et al. |
| 4,954,462 | A | 9/1990 | Wood et al. |
| 5,171,942 | A | 12/1992 | Powers |
| 5,501,906 | A | 3/1996 | Deve |

(Continued)

FOREIGN PATENT DOCUMENTS

| | | |
|---|---|---|
| JP | 5-236274 | 9/1977 |
| JP | 2002-025348 | 11/1977 |

(Continued)

OTHER PUBLICATIONS

Rawlins et al., "Some Effects of Mill Practice on the Stress Strain Behavior of ASCR", IEEE Transactions on Power Delivery, vol. 14, No. 2, Apr. 1999, pp. 602-629.

(Continued)

*Primary Examiner* — Chau Nguyen

(74) *Attorney, Agent, or Firm* — Gregory D. Allen; James A. Baker; Adam Bramwell

(57) ABSTRACT

Cable having a stress parameter less than 0 MPa and method for cable. The cable has a longitudinal core having a thermal expansion coefficient; and a plurality of wires collectively having a thermal expansion coefficient greater than the thermal expansion coefficient of the core. The plurality of wires, which are stranded around the core, include at least one of aluminum wires, copper wires, aluminum alloy wires, or copper alloy wires. Embodiments of the cable are useful, for example, as an overhead power transmission line.

11 Claims, 7 Drawing Sheets

(56) References Cited

U.S. PATENT DOCUMENTS

| | | | | |
|---|---|---|---|---|
| 5,554,826 | A | 9/1996 | Gentry | |
| 5,780,154 | A | 7/1998 | Okano et al. | |
| 6,003,356 | A | 12/1999 | Mills et al. | |
| 6,180,232 | B1 | 1/2001 | McCullough et al. | |
| 6,245,425 | B1 | 6/2001 | McCullough et al. | |
| 6,329,056 | B1 | 12/2001 | Deve et al. | |
| 6,334,293 | B1 | 1/2002 | Poethke et al. | |
| 6,336,495 | B1 | 1/2002 | McCullough et al. | |
| 6,344,270 | B1 | 2/2002 | McCullough et al. | |
| 6,447,927 | B1 | 9/2002 | McCullough et al. | |
| 6,460,597 | B1 | 10/2002 | McCullough et al. | |
| 6,485,796 | B1 | 11/2002 | Carpenter et al. | |
| 6,544,645 | B1 | 4/2003 | McCullough et al. | |
| 6,559,385 | B1 | 5/2003 | Johnson et al. | |
| 6,723,451 | B1 | 4/2004 | McCullough et al. | |
| 7,093,416 | B2 * | 8/2006 | Johnson et al. | 57/212 |
| 2003/0029902 | A1 | 2/2003 | Blucher | |
| 2004/0026112 | A1 | 2/2004 | Goldsworthy et al. | |
| 2005/0178000 | A1 | 8/2005 | McCullough et al. | |
| 2005/0181228 | A1 | 8/2005 | McCullough et al. | |
| 2005/0279074 | A1 | 12/2005 | Johnson et al. | |
| 2005/0279526 | A1 | 12/2005 | Johnson et al. | |
| 2005/0279527 | A1 | 12/2005 | Johnson et al. | |

FOREIGN PATENT DOCUMENTS

| | | | |
|---|---|---|---|
| JP | 59-11366 | | 3/1984 |
| JP | 61-284005 | | 12/1986 |
| JP | 62-86606 | | 4/1987 |
| JP | 3-71509 | | 3/1991 |
| JP | 3-74008 | | 3/1991 |
| JP | 3-129606 | | 6/1991 |
| JP | 3-55531 | | 8/1991 |
| JP | 4-44366 | | 7/1992 |
| JP | 5-23001 | | 3/1993 |
| JP | 6-187851 | | 7/1994 |
| JP | 8-176701 | | 7/1996 |
| JP | 8-306246 | | 11/1996 |
| JP | 9-245527 | | 9/1997 |
| JP | 10-201066 | | 7/1998 |
| JP | 10-241459 | | 9/1998 |
| JP | 2000-90744 | | 3/2000 |
| JP | 2001-43740 | | 2/2001 |
| JP | 52-138685 | | 1/2002 |
| JP | 2004-504484 | | 2/2004 |
| JP | 2004-504485 | | 2/2004 |
| WO | WO 02/06550 | A1 | 1/2002 |
| WO | WO 02/06551 | | 1/2002 |
| WO | WO 02/06552 | | 1/2002 |
| WO | WO 03/091008 | A1 | 11/2003 |

OTHER PUBLICATIONS

Nigol et al., "Characteristics of ACSR Conductors at High Temperatures and Stresses", IEEE Transactions on Power and Systems, vol. PAS-100, No. 2, Feb. 1981, pp. 485-493.

Literature: "1995 The Electricity Society National Symposium—Mechanical Characteristics of SiC Fiber Reinforced Aluminum Composite Material", Ozawa et al., 2 pages, English translation.

Literature: "1995 The Electricity Society Electronics and Energy Department Symposium—Development and Evaluation Characteristics of SiC Fiber Reinforced Aluminum Composite Wires for Transmission Line", 9 pages, English translation.

Ishikawa et al., "Development of New Type Low Sag Conductors Increased Capacity", Published 2002, pp. 1-8.

Johnson et al., "Cable and Method of Making the Same", U.S. Appl. No. 11/317,608, filed Dec. 23, 2005.

3M Technical Notebook, "Aluminum Conductor Composite Reinforced Technical Notebook (477 kcmil family)" Mar. 2003, vol. 2.21, pp. 1-29.

Y. Motlis (Chairman), J.S. Barrett, G.A. Davidson, D.A. Douglass, P.A. Hall, J.L. Reding, T.O. Seppa, F.R. Thrash, Jr., and H.B. White, "Some Error Sources Affecting Sags of Overhead Line Conductors at High Operating Temperatures," Report No. 2 of the IEEE Task Force "Bare Conductor Sag at High Temperature", of the WG "Thermal Aspects of Overhead Conductors", TP&C Subcommittee, pp. 1-12, no date available.

Product Literature: 3M Company, Composite Conductor Field Trial Summary Report: ORNL ACCR 675-TW Kcmil, 2004, 31 pages.

Product Literature: 3M Company, Composite Conductor Field Trial Summary Report: ORNL ACCR 477 Kcmil, 2004, 35 pages.

* cited by examiner

CABLE AND METHOD OF MAKING THE SAME

This is a continuation of application Ser. No. 10/870,401, filed Jun. 17, 2004 now abandoned, the disclosure of which is herein incorporated by reference.

BACKGROUND OF THE INVENTION

In general, composites (including metal matrix composites (MMCs)) are known. Composites typically include a matrix reinforced with particulates, whiskers, or fibers (e.g., short or long short fibers). Examples of metal matrix composites include aluminum matrix composite wires (e.g., silicon carbide, carbon, boron, or polycrystalline alpha alumina fibers embedded in an aluminum matrix), titanium matrix composite tapes (e.g., silicon carbide fibers embedded in a titanium matrix), and copper matrix composite tapes (e.g., silicon carbide or boron fibers embedded in a copper matrix). Examples of polymer matrix composites include carbon or graphite fibers in an epoxy resin matrix, glass or aramid fibers in a polyester resin, and carbon and glass fibers in an epoxy resin.

One use of composite wire (e.g., metal matrix composite wire) is as a reinforcing member in bare overhead electrical power transmission cables. One typical need for cables is driven by the need to increase the power transfer capacity of existing transmission infrastructure.

Desirable performance requirements for cables for overhead power transmission applications include corrosion resistance, environmental endurance (e.g., UV and moisture), resistance to loss of strength at elevated temperatures, creep resistance, as well as relatively high elastic modulus, low density, low coefficient of thermal expansion, high electrical conductivity, and high strength. Although overhead power transmission cables including aluminum matrix composite wires are known, for some applications there is a continuing desire, for example, for more desirable sag properties.

SUMMARY OF THE INVENTION

In one aspect, the present invention provides a cable, comprising:

a longitudinal core having a thermal expansion coefficient; and a plurality of wires collectively having a thermal expansion coefficient greater than the thermal expansion coefficient of the core, wherein the plurality of wires comprise at least one of aluminum wires, copper wires, aluminum alloy wires, or copper alloy wires, and wherein the wires are stranded around the core, wherein the cable has a stress parameter less than 0 MPa (in some embodiments, up to −5 MPa, −10 MPa, −15 MPa, −20 MPa, −25 MPa, −30 MPa, −35 MPa, −40 MPa, −45 MPa, or even up to −50 MPa in some embodiments, in a range from less than 0 to −50 MPa, 0 to −40 MPa, 0 to −30 MPa, 0 to −25 MPa, 0 to −20 MPa, or even, 0 to −10 MPa). In some embodiments, the plurality of wires have a tensile breaking strength of at least 90 MPa, or even at least 100 MPa (calculated according to ASTM B557/B557M (1999), the disclosure of which is incorporated herein by reference).

In another aspect, the present invention provides a method of making a cable according to the present invention, the method comprising:

stranding a plurality of wires around a longitudinal core, wherein the plurality of wires comprise at least one of aluminum wires, copper wires, aluminum alloy wires, or copper alloy wires, the core to provide a preliminary stranded cable; and subjecting the preliminary stranded cable to a closing die to provide the cable, wherein the closing die has an internal diameter, wherein the cable has an exterior diameter, and wherein the interior die diameter is in a range of 1.00 to 1.02 times the exterior cable diameter.

As used herein, the following terms are defined as indicated, unless otherwise specified herein:

"ceramic" means glass, crystalline ceramic, glass-ceramic, and combinations thereof.

"continuous fiber" means a fiber having a length that is relatively infinite when compared to the average fiber diameter. Typically, this means that the fiber has an aspect ratio (i.e., ratio of the length of the fiber to the average diameter of the fiber) of at least $1\times10^5$ (in some embodiments, at least $1\times10^6$, or even at least $1\times10^7$). Typically, such fibers have a length on the order of at least 50 meters, and may even have lengths on the order of kilometers or more.

"shape memory alloy" refers to a metal alloy that undergoes a Martensitic transformation such that the metal alloy is deformable by a twinning mechanism below the transformation temperature, wherein such deformation is reversable when the twin structure reverts to the original phase upon heating above the transformation temperature.

Cables according to the present invention are useful, for example, as electric power transmission cables. Typically, cables according to the present invention exhibit improved sag properties (i.e., reduced sag).

DETAILED DESCRIPTION

Figure 1:
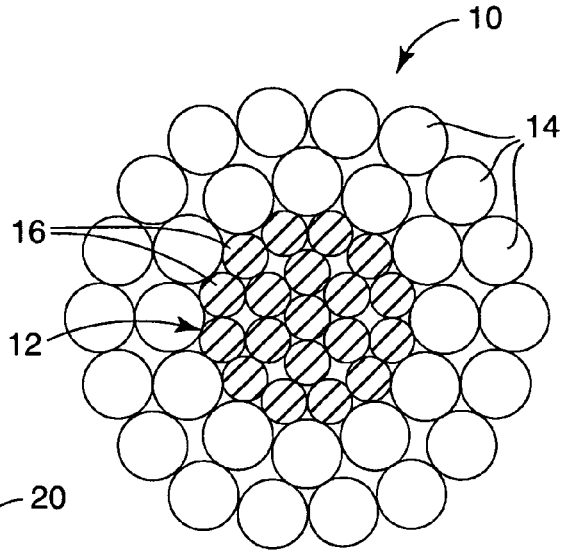
FIGS. 1-5 are schematic, cross-sectional views of exemplary embodiments of cables in accordance with the present invention.

The present invention relates to cables and methods of making cables. A cross-sectional view of an exemplary cable according to the present invention 10 is shown in FIG. 1. Cable 10 includes core 12 and two layers of stranded round wires 14, wherein the core 12 includes wires 16 (as shown, metal matrix composite wires).

Figure 2:
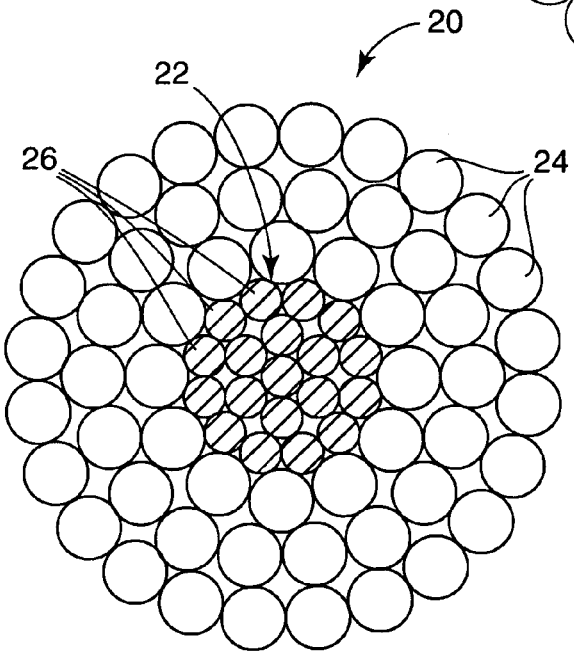

A cross-sectional view of another exemplary cable according to the present invention 20 is shown in FIG. 2. Cable 20 includes core 22 and three layers of stranded wires 24, wherein core 22 includes wires 26 (as shown, metal matrix composite wires).

Figure 3:
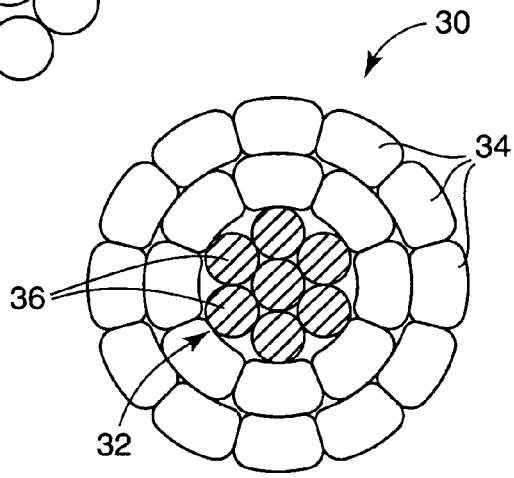

A cross-sectional view of another exemplary cable according to the present invention 30 is shown in FIG. 3. Cable 30 includes core 32 and stranded trapezoidal wires 34, wherein the core 32 includes wires 36 (as shown, metal matrix composite wires).

Figure 4:
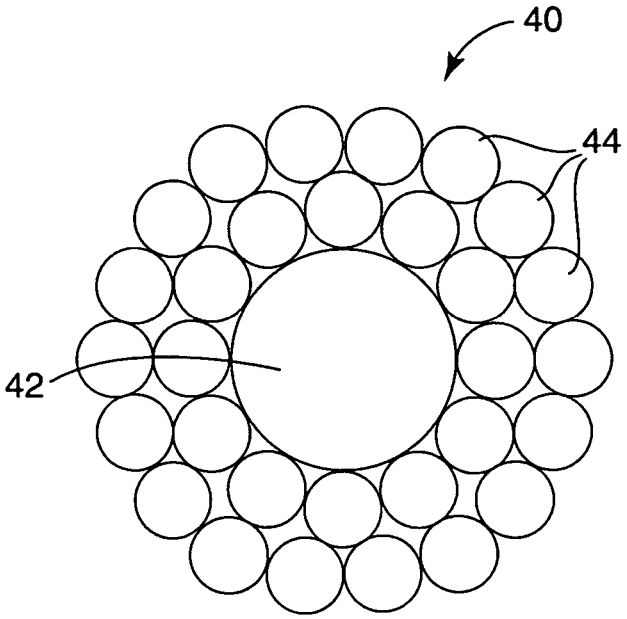

A cross-sectional view of another exemplary cable according to the present invention 40 is shown in FIG. 4. Cable 40 includes core 42 and stranded wires 44.

In some embodiments, the core has a longitudinal thermal expansion coefficient in a range from about 5.5 ppm/° C. to about 7.5 ppm/° C. over at least a temperature range from about −75° C. to about 450° C.

Examples of materials comprising the core include aramid, ceramic, boron, poly(p-phenylene-2,6-benzobisoxazole), graphite, carbon, titanium, tungsten, and/or shape memory alloy. In some embodiments, the materials are in the form of fibers (typically continuous fibers). In some embodiments, cores comprising aramid have a longitudinal thermal expansion coefficient in a range from about −6 ppm/° C. to about 0 ppm/° C. over at least a temperature range from about 20° C. to about 200° C. In some embodiments, cores comprising ceramic have a longitudinal thermal expansion coefficient in a range from about 3 ppm/° C. to about 12 ppm/° C. over at least a temperature range from about 20° C. to about 600° C. In some embodiments, cores comprising boron have a longitudinal thermal expansion coefficient in a range from about 4 ppm/° C. to about 6 ppm/° C. over at least a temperature range from about 20° C. to about 600° C. In some embodiments, cores comprising poly(p-phenylene-2,6-benzobisoxazole) have a longitudinal thermal expansion coefficient in a range from about −6 ppm/° C. to about 0 ppm/° C. over at least a temperature range from about 20° C. to about 600° C. In some embodiments, cores comprising graphite have a longitudinal thermal expansion coefficient in a range from about −2 ppm/° C. to about 2 ppm/° C. over at least a temperature range from about 20° C. to about 600° C. In some embodiments, cores comprising carbon have a longitudinal thermal expansion coefficient in a range from about −2 ppm/° C. to about 2 ppm/° C. over at least a temperature range from about 20° C. to about 600° C. In some embodiments, cores comprising titanium have a longitudinal thermal expansion coefficient in a range from about 10 ppm/° C. to about 20 ppm/° C. over at least a temperature range from about 20° C. to about 800° C. In some embodiments, cores comprising tungsten have a longitudinal thermal expansion coefficient in a range from about 8 ppm/° C. to about 18 ppm/° C. over at least a temperature range from about 20° C. to about 1000° C. In some embodiments, cores comprising shape memory alloy have a longitudinal thermal expansion coefficient in a range from about 8 ppm/° C. to about 25 ppm/° C. over at least a temperature range from about 20° C. to about 1000° C. In some embodiments, cores comprising glass have a longitudinal thermal expansion coefficient in a range from about 4 ppm/° C. to about 10 ppm/° C. over at least a temperature range from about 20° C. to about 600° C.

Examples of fibers for the core include aramid fibers, ceramic fibers, boron fibers, poly(p-phenylene-2,6-benzobisoxazole) fibers, graphite fibers, carbon fibers, titanium fibers, tungsten fibers, and/or shape memory alloy fibers.

Exemplary boron fibers are commercially available, for example, from Textron Specialty Fibers, Inc. of Lowell, Mass. Typically, such fibers have a length on the order of at least 50 meters, and may even have lengths on the order of kilometers or more. Typically, the continuous boron fibers have an average fiber diameter in a range from about 80 micrometers to about 200 micrometers. More typically, the average fiber diameter is no greater than 150 micrometers, most typically in a range from 95 micrometers to 145 micrometers. In some embodiments, the boron fibers have an average tensile strength of at least 3 GPa, and or even at least 3.5 GPa. In some embodiments, the boron fibers have a modulus in a range from about 350 GPa to about 450 GPa, or even in a range from about 350 GPa to about 400 GPa.

In some embodiments, the ceramic fibers have an average tensile strength of at least 1.5 GPa, 2 GPa, 3 GPa, 4 GPa, 5 GPa, 6 GPa, and or even at least 6.5 GPa. In some embodiments, the ceramic fibers have a modulus in a range from 140 GPa to about 500 GPa, or even in a range from 140 GPa to about 450 GPa.

Exemplary carbon fibers are marketed, for example, by Amoco Chemicals of Alpharetta, Ga. under the trade designation "THORNEL CARBON" in tows of 2000, 4000, 5,000, and 12,000 fibers, Hexcel Corporation of Stamford, Conn., from Grafil, Inc. of Sacramento, Calif. (subsidiary of Mitsubishi Rayon Co.) under the trade designation "PYROFIL", Toray of Tokyo, Japan, under the trade designation "TORAYCA", Toho Rayon of Japan, Ltd. under the trade designation "BESFIGHT", Zoltek Corporation of St. Louis, Mo. under the trade designations "PANEX" and "PYRON", and Inco Special Products of Wyckoff, N.J. (nickel coated carbon fibers), under the trade designations "12K20" and "12K50". Typically, such fibers have a length on the order of at least 50 meters, and may even have lengths on the order of kilometers or more. Typically, the continuous carbon fibers have an average fiber diameter in a range from about 4 micrometers to about 12 micrometers, about 4.5 micrometers to about 12 micrometers, or even about 5 micrometers to about 10 micrometers. In some embodiments, the carbon fibers have an average tensile strength of at least 1.4 GPa, at least 2.1 GPa, at least 3.5 GPa, or even at least 5.5 GPa. In some embodiments, the carbon fibers have a modulus greater than 150 GPa to no greater than 450 GPa, or even no greater than 400 GPa.

Exemplary graphite fibers are marketed, for example, by BP Amoco of Alpharetta, Ga., under the trade designation "T-300", in tows of 1000, 3000, and 6000 fibers. Typically, such fibers have a length on the order of at least 50 meters, and may even have lengths on the order of kilometers or more. Typically, the continuous graphite fibers have an average fiber diameter in a range from about 4 micrometers to about 12 micrometers, about 4.5 micrometers to about 12 micrometers, or even about 5 micrometers to about 10 micrometers. In some embodiments, the graphite fibers have an average tensile strength of at least 1.5 GPa, 2 GPa, 3 GPa, or even at least 4 GPa. In some embodiments, the graphite fibers have a modulus in a range from about 200 GPa to about 1200 GPa, or even about 200 GPa to about 1000 GPa.

Exemplary titanium fibers are available, for example, from TIMET, Henderson, Nev. Typically, such fibers have a length on the order of at least 50 meters, and may even have lengths on the order of kilometers or more. Typically, the continuous titanium fibers have an average fiber diameter in a range from 50 micrometers to about 250 micrometers. In some embodiments, the titanium fibers have an average tensile strength of at least 0.7 GPa, 1 GPa, 1.5 GPa, 2 GPa, or even at least 2.1 GPa. In some embodiments, the ceramic fibers have a modulus in a range from about 85 GPa to about 100 GPa, or even from about 85 to about 95 GPa.

Exemplary tungsten fibers are available, for example, from California Fine Wire Company, Grover Beach, Calif. Typically, such fibers have a length on the order of at least 50 meters, and may even have lengths on the order of kilometers or more. Typically, the continuous tungsten fibers have an average fiber diameter in a range from about 100 micrometers to about 500 micrometers about 150 micrometers to about 500 micrometers, or even from about 200 micrometers to about 400 micrometers. In some embodiments, the tungsten fibers have an average tensile strength of at least 0.7 GPa, 1 GPa, 1.5 GPa, 2 GPa, or even at least 2.3 GPa. In some embodiments, the tungsten fibers have a modulus greater than 400 GPa to about no greater than 420 GPa, or even no greater than 415 GPa Exemplary shape memory alloy fibers are available, for example, from Johnson Matthey, West Whiteland, Pa. Typically, such fibers have a length on the order of at least 50 meters, and may even have lengths on the order of kilometers or more. Typically, the continuous shape memory alloy fibers have an average fiber diameter in a range from about 50 micrometers to about 400 micrometers, about 50 to about 350 micrometers, or even about 100 micrometers to 300 micrometers. In some embodiments, the shape memory alloy fibers have an average tensile strength of at least 0.5 GPa, and or even at least 1 GPa. In some embodiments, the shape memory alloy fibers have a modulus in a range from about 20 GPa to about 100 GPa, or even from about 20 GPA to about 90 GPa.

Exemplary aramid fibers are available, for example, from DuPont, Wilmington, Del. under the trade designation "KEVLAR". Typically, such fibers have a length on the order of at least 50 meters, and may even have lengths on the order of kilometers or more. Typically, the continuous aramid fibers have an average fiber diameter in a range from about 10 micrometers to about 15 micrometers. In some embodiments, the aramid fibers have an average tensile strength of at least 2.5 GPa, 3 GPa, 3.5 GPa, 4 GPa, or even at least 4.5 GPa. In some embodiments, the aramid fibers have a modulus in a range from about 80 GPa to about 200 GPa, or even about 80 GPa to about 180 GPa.

Exemplary poly(p-phenylene-2,6-benzobisoxazole) fibers are available, for example, from Toyobo Co., Osaka, Japan under the trade designation "ZYLON". Typically, such fibers have a length on the order of at least 50 meters, and may even have lengths on the order of kilometers or more. Typically, the continuous poly(p-phenylene-2,6-benzobisoxazole) fibers have an average fiber diameter in a range from about 8 micrometers to about 15 micrometers. In some embodiments, the poly(p-phenylene-2,6-benzobisoxazole) fibers have an average tensile strength of at least 3 GPa, 4 GPa, 5 GPa, 6 GPa, or even at least 7 GPa. In some embodiments, the poly (p-phenylene-2,6-benzobisoxazole) fibers have a modulus in a range from about 150 GPa to about 300 GPa, or even about 150 GPa to about 275 GPa.

Examples of ceramic fiber include metal oxide (e.g., alumina) fibers, boron nitride fibers, silicon carbide fibers, and combination of any of these fibers. Typically, the ceramic oxide fibers are crystalline ceramics and/or a mixture of crystalline ceramic and glass (i.e., a fiber may contain both crystalline ceramic and glass phases). Typically, such fibers have a length on the order of at least 50 meters, and may even have lengths on the order of kilometers or more. Typically, the continuous crystalline ceramic fibers have an average fiber diameter in a range from about 5 micrometers to about 50 micrometers, about 5 micrometers to about 25 micrometers about 8 micrometers to about 25 micrometers, or even about 8 micrometers to about 20 micrometers. In some embodiments, the crystalline ceramic fibers have an average tensile strength of at least 1.4 GPa, at least 1.7 GPa, at least 2.1 GPa, and or even at least 2.8 GPa. In some embodiments, the crystalline ceramic fibers have a modulus greater than 70 GPa to approximately no greater than 1000 GPa, or even no greater than 420 GPa.

Examples of monofilament ceramic fibers include silicon carbide fibers. Typically, the silicon carbide monofilament fibers are crystalline and/or a mixture of crystalline ceramic and glass (i.e., a fiber may contain both crystalline ceramic and glass phases). Typically, such fibers have a length on the order of at least 50 meters, and may even have lengths on the order of kilometers or more. Typically, the continuous silicon carbide monofilament fibers have an average fiber diameter in a range from about 100 micrometers to about 250 micrometers. In some embodiments, the crystalline ceramic fibers have an average tensile strength of at least 2.8 GPa, at least 3.5 GPa, at least 4.2 GPa and or even at least 6 GPa. In some embodiments, the crystalline ceramic fibers have a modulus greater than 250 GPa to approximately no greater than 500 GPa, or even no greater than 430 GPa.

Further, exemplary glass fibers are available, for example, from Corning Glass, Corning N.Y. Typically, the continuous glass fibers have an average fiber diameter in a range from about 3 micrometers to about 19 micrometers. In some embodiments, the glass fibers have an average tensile strength of at least 3 GPa, 4 GPa, and or even at least 5 GPa. In some embodiments, the glass fibers have a modulus in a range from about 60 GPa to 95 GPa, or about 60 GPa to about 90 GPa.

In some embodiments of ceramic fibers and carbon fibers are in tows. Tows are known in the fiber art and refer to a plurality of (individual) fibers (typically at least 100 fibers, more typically at least 400 fibers) collected in a roving-like form. In some embodiments, tows comprise at least 780 individual fibers per tow, and in some cases, at least 2600 individual fibers per tow. Tows of ceramic fibers are available in a variety of lengths, including 300 meters, 500 meters, 750 meters, 1000 meters, 1500 meters, 1750 meters, and longer. The fibers may have a cross-sectional shape that is circular or elliptical. In some embodiments of carbon fibers, tows comprise at least 2,000 5,000 12,000, or even at least 50,000 individual fibers per tow.

Alumina fibers are described, for example, in U.S. Pat. No. 4,954,462 (Wood et al.) and U.S. Pat. No. 5,185,29 (Wood et al.). In some embodiments, the alumina fibers are polycrystalline alpha alumina fibers and comprise, on a theoretical oxide basis, greater than 99 percent by weight $Al_2O_3$ and 0.2-0.5 percent by weight $SiO_2$, based on the total weight of the alumina fibers. In another aspect, some desirable polycrystalline, alpha alumina fibers comprise alpha alumina having an average grain size of less than 1 micrometer (or even, in some embodiments, less than 0.5 micrometer). In another aspect, in some embodiments, polycrystalline, alpha alumina fibers have an average tensile strength of at least 1.6 GPa (in some embodiments, at least 2.1 GPa, or even, at least 2.8 GPa). Exemplary alpha alumina fibers are marketed under the trade designation "NEXTEL 610" by 3M Company, St. Paul, Minn.

Aluminosilicate fibers are described, for example, in U.S. Pat. No. 4,047,965 (Karst et al). Exemplary aluminosilicate fibers are marketed under the trade designations "NEXTEL 440", "NEXTEL 550", and "NEXTEL 720" by 3M Company of St. Paul, Minn.

Aluminoborosilicate fibers are described, for example, in U.S. Pat. No. 3,795,524 (Sowman). Exemplary aluminoborosilicate fibers are marketed under the trade designation "NEXTEL 312" by 3M Company.

Boron nitride fibers can be made, for example, as described in U.S. Pat. No. 3,429,722 (Economy) and U.S. Pat. No. 5,780,154 (Okano et al.).

Exemplary silicon carbide fibers are marketed, for example, by COI Ceramics of San Diego, Calif. under the trade designation "NICALON" in tows of 500 fibers, from Ube Industries of Japan, under the trade designation "TYR- ANNO", and from Dow Corning of Midland, Mich. under the trade designation "SYLRAMIC".

Exemplary silicon carbide monofilament fibers are marketed, for example, by Textron Specialty Materials of Lowell, Mass. under the trade designation "SCS-9", "SCS-6" and "Ulra-SCS", and from Atlantic Research Corporation, of Gainesville, Va. under the trade designation "Trimarc".

Commercially available fibers typically include an organic sizing material added to the fiber during manufacture to provide lubricity and to protect the fiber strands during handling. Also the sizing may aid in handling during pultrusion with polymers to make polymer composite core wires. The sizing may be removed, for example, by dissolving or burning the sizing away from the fibers. Typically, it is desirable to remove the sizing before forming metal matrix composite wire.

The fibers may have coatings used, for example, to enhance the wettability of the fibers, to reduce or prevent reaction between the fibers and molten metal matrix material. Such coatings and techniques for providing such coatings are known in the fiber and composite art.

In some embodiments, at least 85% (in some embodiments, at least 90%, or even at least 95%) by number of the fibers in the core are continuous.

Exemplary matrix materials for composite cores and wires include polymers (e.g., epoxies, esters, vinyl esters, polyimides, polyesters, cyanate esters, phenolic resins, bismaleimide resins and thermoplastics) and metal(s) (e.g., highly pure, (e.g., greater than 99.95%) elemental aluminum or alloys of pure aluminum with other elements, such as copper). Typically, the metal matrix material is selected such that the matrix material does not significantly chemically react with the fiber (i.e., is relatively chemically inert with respect to fiber material), for example, to eliminate the need to provide a protective coating on the fiber exterior. Exemplary metal matrix materials include aluminum, zinc, tin, magnesium, and alloys thereof (e.g., an alloy of aluminum and copper). In some embodiments, the matrix material desirably includes aluminum and alloys thereof.

In some embodiments, the metal matrix comprises at least 98 percent by weight aluminum, at least 99 percent by weight aluminum, greater than 99.9 percent by weight aluminum, or even greater than 99.95 percent by weight aluminum. Exemplary aluminum alloys of aluminum and copper comprise at least 98 percent by weight Al and up to 2 percent by weight Cu. In some embodiments, useful alloys are 1000, 2000, 3000, 4000, 5000, 6000, 7000 and/or 8000 series aluminum alloys (Aluminum Association designations). Although higher purity metals tend to be desirable for making higher tensile strength wires, less pure forms of metals are also useful.

Suitable metals are commercially available. For example, aluminum is available under the trade designation "SUPER PURE ALUMINUM; 99.99% Al" from Alcoa of Pittsburgh, Pa. Aluminum alloys (e.g., Al-2% by weight Cu (0.03% by weight impurities)) can be obtained, for example, from Belmont Metals, New York, N.Y. Zinc and tin are available, for example, from Metal Services, St. Paul, Minn. ("pure zinc"; 99.999% purity and "pure tin"; 99.95% purity). For example, magnesium is available under the trade designation "PURE" from Magnesium Elektron, Manchester, England. Magnesium alloys (e.g., WE43A, EZ33A, AZ81A, and ZE41A) can be obtained, for example, from TIMET, Denver, Colo.

The composite cores and wires typically comprise at least 15 percent by volume (in some embodiments, at least 20, 25, 30, 35, 40, 45, or even 50 percent by volume) of the fibers, based on the total combined volume of the fibers and matrix material. More typically the composite cores and wires comprise in the range from 40 to 75 (in some embodiments, 45 to 70) percent by volume of the fibers, based on the total combined volume of the fibers and matrix material.

Typically the average diameter of the core is in a range from about 1 mm to about 15 mm. In some embodiments, the average diameter of core desirable is at least 1 mm, at least 2 mm, or even up to about 3 mm. Typically the average diameter of the composite wire is in a range from about 1 mm to 12 mm, 1 mm to 10 mm, 1 to 8 mm, or even 1 mm to 4 mm. In some embodiments, the average diameter of composite wire desirable is at least 1 mm, at least 1.5 mm, 2 mm, 3 mm, 4 mm, 5 mm, 6 mm, 7 mm, 8 mm, 9 mm, 10 mm, 11 mm, or even at least 12 mm.

Composite cores and wires can be made using techniques known in the art. Continuous metal matrix composite wire can be made, for example, by continuous metal matrix infiltration processes. One suitable process is described, for example, in U.S. Pat. No. 6,485,796 (Carpenter et al.), the disclosure of which is incorporated herein by reference. Wires comprising polymers and fiber may be made by pultrusion processes which are known in the art.

Figure 6:
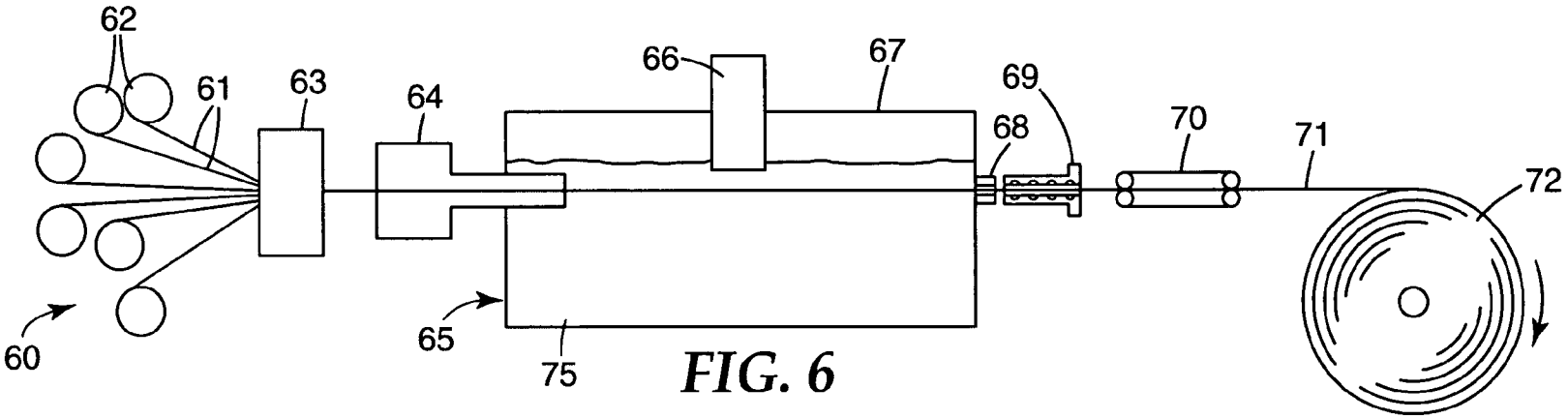
FIG. 6 is a schematic view of an exemplary ultrasonic infiltration apparatus used to infiltrate fibers with molten metals in accordance with the present invention.

A schematic of an exemplary apparatus 60 for making continuous metal matrix wire is shown in FIG. 6. Tows of continuous fibers 61 are supplied from supply spools 62, and are collimated into a circular bundle and for fibers, heat-cleaned while passing through tube furnace 63. Tow of fibers 61 are then evacuated in vacuum chamber 64 before entering crucible 67 containing melt 65 of metallic matrix material (also referred to herein as "molten metal"). Tows of fibers are pulled from supply spools 62 by caterpuller 70. Ultrasonic probe 66 is positioned in melt 65 in the vicinity of the fiber to aid in infiltrating melt 65 into tows of fibers 61. The molten metal of the wire 71 cools and solidifies after exiting crucible 67 through exit die 68, although some cooling may occur before wire 71 fully exits crucible 67. Cooling of wire 71 is enhanced by streams of gas or liquid delivered through cooling device 69, that impinge on wire 71. Wire 71 is collected onto spool 72.

As discussed above, heat-cleaning the fiber helps remove or reduce the amount of sizing, adsorbed water, and other fugitive or volatile materials that may be present on the surface of the fibers. Typically, it is desirable to heat-clean the fibers until the carbon content on the surface of the fiber is less than 22% area fraction. Typically, the temperature of tube furnace 63 is at least 300° C., more typically, at least 1000° C., and the fiber resides in tube furnace 63 for at least several seconds at temperature, although the particular temperature(s) and time(s) may depend, for example, on the cleaning needs of the particular fiber being used.

In some embodiments, tows of fibers 61 are evacuated before entering melt 67, as it has been observed that use of such evacuation tends to reduce or eliminate the formation of defects, such as localized regions with dry fibers (i.e., fiber regions without infiltration of the matrix). Typically, twos of fibers 61 are evacuated in a vacuum of in some embodiments not greater than 20 torr, not greater than 10 torr, not greater than 1 torr, or even not greater than 0.7 torr.

An exemplary suitable vacuum system 64 has an entrance tube sized to match the diameter of the bundle of tows of fiber 61. The entrance tube can be, for example, a stainless steel or alumina tube, and is typically at least about 20-30 cm long. A suitable vacuum chamber 64 typically has a diameter in the range from about 2-20 cm, and a length in the range from about 5-100 cm. The capacity of the vacuum pump is, in some embodiments, at least about 0.2-1 cubic meters/minute. The evacuated tows of fibers 61 are inserted into melt 65 through a tube on vacuum system 64 that penetrates the metal bath (i.e., the evacuated bundle of tows of fibers 61 are under vacuum when introduced into the melt 65), although melt 65 is typically at atmospheric pressure. The inside diameter of the exit tube essentially matches the diameter of bundle of tows of fibers 61. A portion of the exit tube is immersed in the molten metal. In some embodiments, about 0.5-5 cm of the tube is immersed in the molten metal. The tube is selected to be stable in the molten metal material. Examples of tubes which are typically suitable include silicon nitride and alumina tubes.

Infiltration of molten metal 65 into bundle of tows of fibers 61 is typically enhanced by the use of ultrasonics. For example, vibrating horn 66 is positioned in molten metal 65 such that it is in close proximity to bundle of tows of fibers 61.

In some embodiments, horn 66 is driven to vibrate in the range of about 19.5-20.5 kHz and an amplitude in air of about 0.13-0.38 mm (0.005-0.015 in). Further, in some embodiments, the horn is connected to a titanium waveguide which, in turn, is connected to the ultrasonic transducer (available, for example, from Sonics & Materials, Danbury Conn.).

In some embodiments, bundle of tows of fibers 61 are within about 2.5 mm (in some embodiments within about 1.5 mm) of the horn tip. The horn tip is, in some embodiments, made of niobium, or alloys of niobium, such as 95 wt. % Nb-5 wt. % Mo and 91 wt. % Nb-9 wt. % Mo, and can be obtained, for example, from PMTI, Pittsburgh, Pa. The alloy can be fashioned, for example, into a cylinder 12.7 cm in length (5 in.) and 2.5 cm in diameter (1 in.). The cylinder can be tuned to a desired vibration frequency (e.g., about 19.5-20.5 kHz) by altering its length. For additional details regarding the use of ultrasonics for making metal matrix composite articles, see, for example, U.S. Pat. No. 4,649,060 (Ishikawa et al.), U.S. Pat. No. 4,779,563 (Ishikawa et al.), and U.S. Pat. No. 4,877,643 (Ishikawa et al.), U.S. Pat. No. 6,180,232 (McCullough et al.), U.S. Pat. No. 6,245,425 (McCullough et al.), U.S. Pat. No. 6,336,495 (McCullough et al.), U.S. Pat. No. 6,329,056 (Deve et al.), U.S. Pat. No. 6,344,270 (McCullough et al.), U.S. Pat. No. 6,447,927 (McCullough et al.), U.S. Pat. No. 6,460,597 (McCullough et al.), U.S. Pat. No. 6,485,796 (Carpenter et al.), and U.S. Pat. No. 6,544,645 (McCullough et al.); U.S. application having Ser. No. 09/616,741, filed Jul. 14, 2000; and PCT application having Publication No. WO02/06550, published Jan. 24, 2002.

Typically, molten metal 65 is degassed (e.g., reducing the amount of gas (e.g., hydrogen in aluminum) dissolved in molten metal 65 during and/or prior to infiltration. Techniques for degassing molten metal 65 are well known in the metal processing art. Degassing melt 65 tends to reduce gas porosity in the wire. For molten aluminum, the hydrogen concentration of melt 65 is in some embodiments, less than about 0.2, 0.15, or even less than about 0.1 $cm^3$/100 gram of aluminum.

Exit die 68 is configured to provide the desired wire diameter. Typically, it is desired to have a uniformly round wire along its length. For example, the diameter of a silicon nitride exit die for an aluminum composite wire containing 58 volume percent alumina fibers is the same as the diameter of wire 71. In some embodiments, exit die 68 is desirably made of silicon nitride, although other materials may also be useful. Other materials that have been used as exit dies in the art include conventional alumina. It has been found by Applicants, however, that silicon nitride exit dies wear significantly less than conventional alumina dies, and hence are more useful for providing the desired diameter and shape of the wire, particularly over long lengths of wire.

Typically, wire 71 is cooled after exiting exit die 68 by contacting the wire 71 with liquid (e.g., water) or gas (e.g., nitrogen, argon, or air) delivered through a cooling device 69. Such cooling aids in providing the desirable roundness and uniformity characteristics, and freedom from voids. Wire 71 is collected on spool 72.

It is known that the presence of imperfections in the metal matrix composite wire, such as intermetallic phases; dry fiber; porosity as a result, for example, of shrinkage or internal gas (e.g., hydrogen or water vapor) voids; etc. may lead to diminished properties, such as wire strength. Hence, it is desirable to reduce or minimize the presence of such characteristics.

Figure 5:
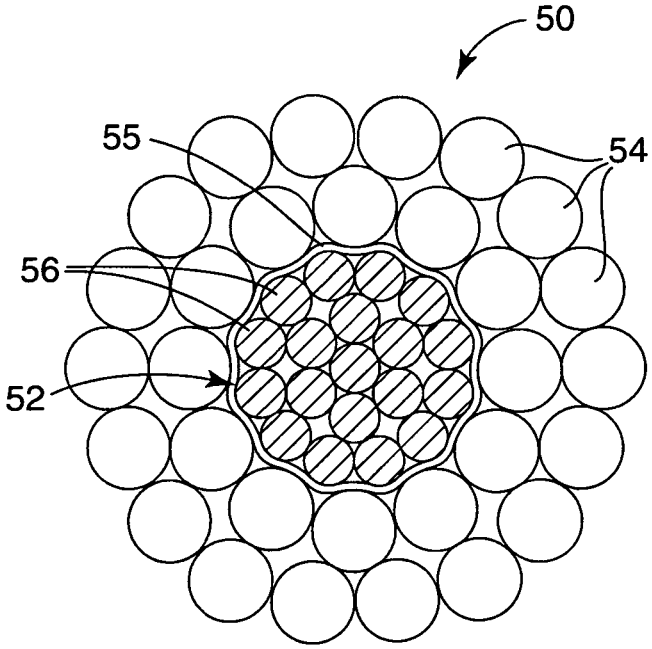

For cores comprised of wires, it is desirable in some embodiments, hold the wires together, for example, a tape overwrap, with or without adhesive, or a binder (see, e.g., U.S. Pat. No. 6,559,385 B1 (Johnson et al.)). For example, a cross-sectional view of another exemplary cable according to the present invention 50 having a tape-wrapped core is shown in FIG. 5. Cable 50 includes core 52 and two layers of stranded wires 54, wherein core 52 includes wires 56 (as shown, composite wires) wrapped with tape 55. For example, the core can be made by stranding (e.g., helically winding) a first layer of wires around a central wire using techniques known in the art. Typically, helically stranded cores tend to comprise as few as 7 individual wires to 50 or more wires. Stranding equipment is known in the art (e.g., planetary cable stranders such as those available from Cortinovis, Spa, of Bergamo, Italy, and from Watson Machinery International, Patterson, N.J.). Prior to being helically wound together, the individual wires are provided on separate bobbins which are then placed in a number of motor driven carriages of the stranding equipment. Typically, there is one carriage for each layer of the finished stranded cable. The wires of each layer are brought together at the exit of each carriage and arranged over the first central wire or over the preceding layer. During the cable stranding process, the central wire, or the intermediate unfinished stranded cable which will have one or more additional layers wound about it, is pulled through the center of the various carriages, with each carriage adding one layer to the stranded cable. The individual wires to be added as one layer are simultaneously pulled from their respective bobbins while being rotated about the central axis of the cable by the motor driven carriage. This is done in sequence for each desired layer. The result is a helically stranded core. Tape, for example, can be applied to the resulting stranded core aid in holding the stranded wires together. One exemplary machine for applying tape is commercially available from Watson Machine International (e.g., model 300 Concentric Taping Head). Exemplary tapes include metal foil tape (e.g., aluminum foil tape (available, for example, from the 3M Company, St Paul, Minn. under the trade designation "Foil/Glass Cloth Tape 363")), polyester backed tape; and tape having a glass reinforced backing. In some embodiments, the tape has a thickness in a range from 0.05 mm to 0.13 mm (0.002 to 0.005 inch).

In some embodiments, the tape is wrapped such that each successive wrap abuts the previous wrap without a gap and without overlap. In some embodiments, for example, the tape can be wrapped so that successive wraps are spaced to leave a gap between each wrap.

Cores, composite wires, cables, etc. have a length, of at least 100 meters, of at least 200 meters, of at least 300 meters, at least 400 meters, at least 500 meters, at least 600 meters, at least 700 meters, at least 800 meters, or even at least 900 meters.

Wires for stranding around a core to provide a cable according to the present invention are known in the art. Aluminum wires are commercially available, for example from Nexans, Weyburn, Canada or Southwire Company, Carrolton, Ga. under the trade designations "1350-H19 ALUMINUM" and "1350-H0 ALUMINUM". Typically, aluminum wire have a thermal expansion coefficient in a range from about 20 ppm/° C. to about 25 ppm/° C. over at least a temperature range from about 20° C. to about 50° C. In some embodiments, aluminum wires (e.g., "1350-H19 ALUMINUM") have a tensile breaking strength, at least 138 MPa (20 ksi), at least 158 MPa (23 ksi), at least 172 MPa (25 ksi) or at least 186 MPa (27 ksi) or at least 200 MPa (29 ksi.). In some embodiments, aluminum wires (e.g., "1350-H0 ALUMINUM") have a tensile breaking strength greater than 41 MPa (6 ksi) to no greater than 97 MPa (14 ksi), or even no greater than 83 MPa (12 ksi). Aluminum alloy wires are commercially available, for example from Sumitomo Electric Industries, Osaka, Japan under the trade designation "ZTAL"", or Southwire Company, Carrolton, Ga., under the designation "6201". In some embodiments, aluminum alloy wires have a thermal expansion coefficient in a range from about 20 ppm/° C. to about 25 ppm/° C. over at least a temperature range from about 20° C. to about 500° C. Copper wires are commercially available, for example from Southwire Company, Carrolton, Ga. Typically, copper wires have a thermal expansion coefficient in a range from about 12 ppm/° C. to about 18 ppm/° C. over at least a temperature range from about 20° C. to about 800° C. Copper alloy (e.g. copper bronzes such as Cu—Si—X, Cu—Al—X, Cu—Sn—X, Cu—Cd; where X=Fe, Mn, Zn, Sn and or Si; commercially available, for example from Southwire Company, Carrolton, Ga.; oxide dispersion strengthened copper available, for example, from OMG Americas Corporation, Research Triangle Park, N.C., under the designation "GLIDCOP") wires. In some embodiments, copper alloy wires have a thermal expansion coefficient in a range from about 10 ppm/° C. to about 25 ppm/° C. over at least a temperature range from about 20° C. to about 800° C. The wires may be in any of a variety shapes (e.g., circular, elliptical, and trapezoidal).

Figure 7:
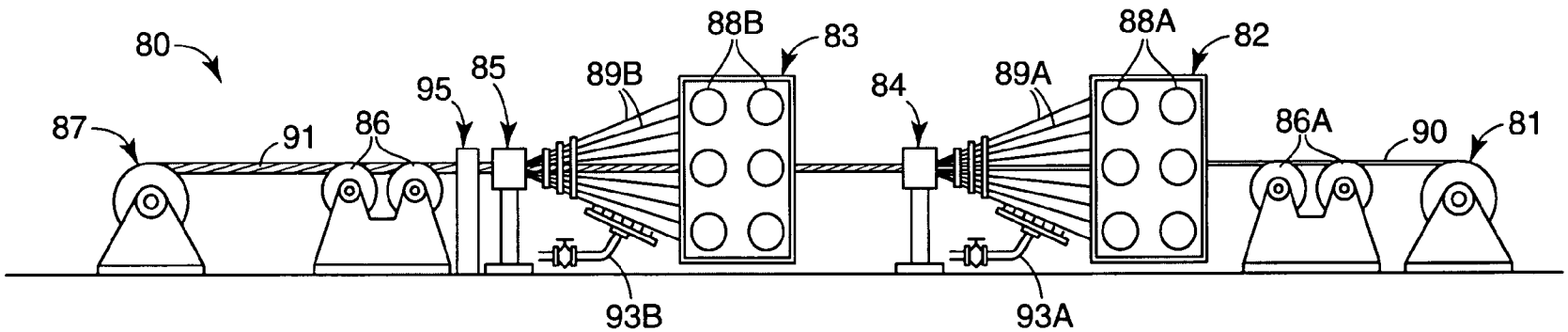
FIGS. 7, 7A, and 7B are schematic views of an exemplary stranding apparatus used to make cable in accordance with the present invention.
Figure 7A:
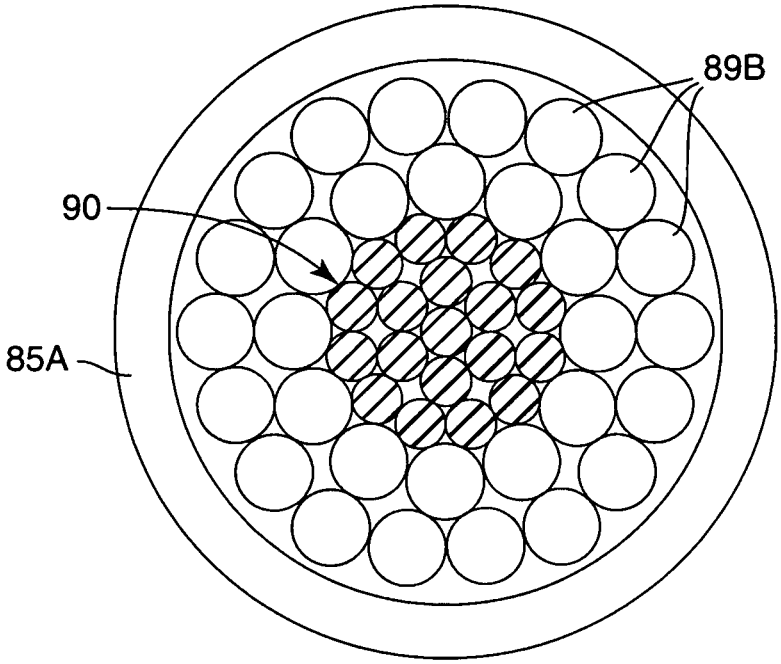
Figure 7B:
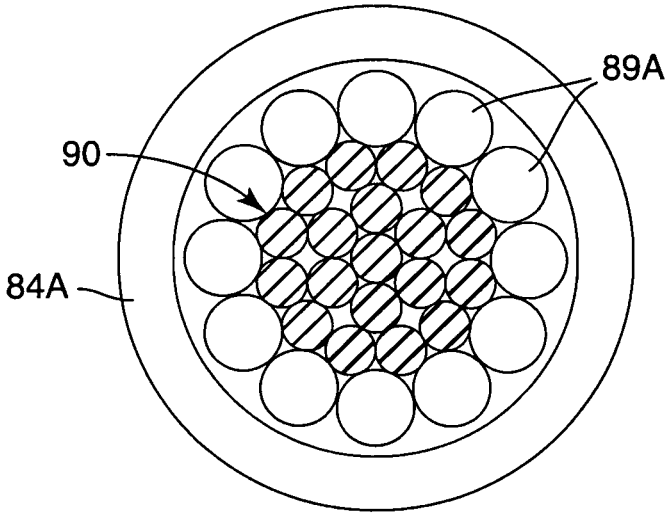

In general, cable according to the present invention can be made by stranding wires over a core. The core may include, for example, a single wire, or stranded (e.g., helically wound wires. In some embodiments, for example, 7, 19 or 37 wires. Exemplary apparatus 80 for making cable according to the present invention is shown in FIGS. 7, 7A, and 7B. Spool of core material 81 is provided at the head of a conventional planetary stranding machine 80, wherein spool 81 is free to rotate, with tension capable of being applied via a braking system where tension can be applied to the core during payoff in the range of 0-91 kg (0-200 lbs.). Core 90 is threaded through bobbin carriages 82, 83, through closing dies 84, 85, around capstan wheels 86 and attached to take-up spool 87.

Prior to the application of the outer stranding layers, individual wires are provided on separate bobbins 88 which are placed in a number of motor driven carriages 82, 83 of the stranding equipment. In some embodiments, the range of tension required to pull wire 89A, 89B from the bobbins 88 is typically 4.5-22.7 kg (10-50 lbs.). Typically, there is one carriage for each layer of the finished stranded cable. Wires of each layer are brought together at the exit of each carriage at a closing die 84, 85 and arranged over the central wire or over the preceding layer. Layers are helically stranded in opposite directions such that the outer layer results in a right hand lay. During the cable stranding process, the central wire, or the intermediate unfinished stranded cable which will have one or more additional layers wound about it, is pulled through the center of the various carriages, with each carriage adding one layer to the stranded cable. The individual wires to be added as one layer are simultaneously pulled from their respective bobbins while being rotated about the central axis of the cable by the motor driven carriage. This is done in sequence for each desired layer. The result is a helically stranded cable 91 that can be cut and handled conveniently without loss of shape or unraveling.

This ability to handle the stranded cable is a desirable feature. Although not wanting to be bound by theory, the cable maintains its helically stranded arrangement because during manufacture, the metallic wires are subjected to stresses, including bending stresses, beyond the yield stress of the wire material but below the ultimate or failure stress. This stress is imparted as the wire is helically wound about the relatively small radius of the preceding layer or central wire. Additional stresses are imparted at closing dies 84, 85 which apply radial and shear forces to the cable during manufacture. The wires therefore plastically deform and maintain their helically stranded shape.

The core material and wires for a given layer are brought into intimate contact via closing dies. Referring to FIGS. 7A and 7B, closing die 84A, 85A are typically sized to minimize the deformation stresses on the wires of the layer being wound. The internal diameter of the closing die is tailored to the size of the external layer diameter. To minimize stresses on the wires of the layer, the closing die is sized such that it is in the range from 0-2.0% larger, relative to the external diameter of the cable. (i.e., the interior die diameters are in a range of 1.00 to 1.02 times the exterior cable diameter).

Exemplary closing dies shown in FIGS. 7A and 7B are cylinders, and are held in position, for example, using bolts or other suitable attachments. The dies can be made, for example, of hardened tool steel.

The resulting cable may pass through other stranding stations, if desired, and ultimately wound onto take-up spool 87 of sufficient diameter to avoid cable damage. In some embodiments, techniques known in the art for straightening the cable may be desirable. For example, the finished cable can be passed through a straightener device comprised of rollers (each roller being for example, 10-15 cm (4-6 inches), linearly arranged in two banks, with, for example, 5-9 rollers in each bank. The distance between the two banks of rollers may be varied so that the rollers just impinge on the cable or cause severe flexing of the cable. The two banks of rollers are positioned on opposing sides of the cable, with the rollers in one bank matching up with the spaces created by the opposing rollers in the other bank. Thus, the two banks can be offset from each other. As the cable passes through the straightening device, the cable flexes back and forth over the rollers, allowing the strands in the conductor to stretch to the same length, thereby reducing or eliminating slack strands.

In some embodiments, it may be desirable to provide the core at an elevated temperature (e.g., at least 25° C., 50° C., 75° C., 100° C., 125° C., 150° C., 200° C., 250° C., 300° C., 400° C., or even, in some embodiments, at least 500° C.) above ambient temperature (e.g., 22° C.). The core can be brought to the desired temperature, for example, by heating spooled core (e.g., core on a metal (e.g., steel) in an oven for several hours. The heated spooled core is placed on the pay-off spool (see, e.g., pay-off spool 71 in FIG. 7) of a stranding machine. Desirably, the spool at elevated temperature is in the stranding process while the core is still at or near the desired temperature (typically within about 2 hours). Further it may be desirable, for the wires on the payoff spools that form the outer layers of the cable, to be at the ambient temperature. That is, in some embodiments, it may be desirable to have a temperature differential between the core and wires form the outer later during the stranding process.

In some embodiments, it may be desirable to conduct the stranding with a core tension of at least 100 kg, 200 kg, 500 kg, 1000 kg., or even at least 5000 kg.

In some embodiments of cables according to the present invention, it is desirable to hold the wires that are stranded around the core together, for example, a tape overwrap, with or without adhesive, or a binder. For example, a cross-sectional view of another exemplary includes core 112 with wires core 116 and two layers of stranded wires 114, wherein cable 110 is wrapped with tape 118. Tape, for example, can be applied to the resulting stranded cable to aid in holding the stranded wires together. In some embodiments the cable is be wrapped with adhesive tape using conventional taping equipment. One exemplary machine for applying tape is commercially available from Watson Machine International (e.g., model 300 Concentric Taping Head). Exemplary tapes include metal foil tape (e.g., aluminum foil tape (available, for example, from the 3M Company, St Paul, Minn. under the trade designation "Foil/Glass Cloth Tape 363")), polyester backed tape; and tape having a glass reinforced backing. In some embodiments, the tape has a thickness in a range from 0.05 mm to 0.13 mm (0.002 to 0.005 inch).

In some embodiments, the tape is wrapped such that each successive wrap overlaps the previous. In some embodiments, the tape is wrapped such that each successive wrap abuts the previous wrap without a gap and without overlap. In some embodiments, for example, the tape can be wrapped so that successive wraps are spaced to leave a gap between each wrap.

In some embodiments the cable is wrapped while the cable is under tension during the stranding process. Referring to FIG. 7, for example, taping equipment would be located between the final closing die 85 and capstan 86.

Method for Measuring Sag

A length of conductor is selected 30-300 meters in length and is terminated with conventional epoxy fittings, ensuring the layers substantially retain the same relative positions as in the as manufactured state. The outer wires are extended through the epoxy fittings and out the other side, and then reconstituted to allow for connection to electrical AC power using conventional terminal connectors. The epoxy fittings are poured in aluminum spelter sockets that are connected to turnbuckles for holding tension. On one side, a load cell is connected to a turnbuckle and then at both ends the tumbuckles are attached to pulling eyes. The eyes were connected to large concrete pillars, large enough to minimize end deflections of the system when under tension. For the test, the tension is pulled to a value in a range from 10 to 30 percent of the conductor rated breaking strength. The temperature is measured at three locations along the length of the conductor (at ¼, ½ and ¾ of the distance of the total (pulling-eye to pulling-eye) span) using nine thermocouples. At each location, the three thermocouples are positioned in three different radial positions within the conductor; between the outer wire strands, between the inner wire strands, and adjacent to (i.e., contacting) the outer core wires. The sag values are measured at three locations along the length of the conductor (at ¼, ½ and ¾ of the distance of the span) using pull wire potentiometers (available from SpaceAge Control, Inc, Palmdale, Calif.). These are positioned to measure the vertical movement of the three locations. AC current is applied to the conductor to increase the temperature to the desired value. The temperature of the conductor is raised from room temperature (about 20° C. (68° F.)) to about 240° C. (464° F.) at a rate in the range of 60-120° C./minute (140-248° F./minute). The highest temperature of all of the thermocouples is used as the control.

The sag value of the conductor ($Sag_{total}$) is calculated at various temperatures in one degree intervals from room temperature (about 20° C. (68° F.)) to about 240° C. (464° F.)) using the following equation:

$$Sag_{total} = Sag_{1/2} - \left(\frac{Sag_{1/4} + Sag_{3/4}}{2}\right) \quad (1)$$

Where:

$Sag_{1/2}$=sag measured at ½ the distance of the span of the conductor $Sag_{1/4}$=sag measured at ¼ the distance of the span of the conductor $Sag_{3/4}$=sag measured at ¾ the distance of the span of the conductor The effective "inner span" length is the horizontal distance between the ¼ and ¾ positions. This is the span length used to compute the sag.

Derivation of Stress Parameter

The measured sag and temperature data is plotted as a graph of sag versus temperature. A calculated curve is fit to the measured data using the Alcoa Sag10 graphic method available in a software program from Alcoa Fujikura Ltd., Greenville, S.C. under the trade designation "SAG10" (version 3.0 update 3.9.7). The stress parameter is a fitting parameter in "SAG10" labeled as the "built-in aluminum stress" which can be altered to fit other parameters if material other than aluminum is used (e.g., aluminum alloy), and which adjusts the position of the knee-point on the predicted graph and also the amount of sag in the high temperature, post-knee-point regime. A description of the stress parameter theory is provided in the Alcoa Sag10 Users Manual (Version 2.0): Theory of Compressive Stress in Aluminum of ACSR, the disclosure of which is incorporated herein by reference. The following conductor parameters are required for entry into the Sag10 Software; area, diameter, weight per unit length, and rated breaking strength. The following line loading conditions are required for entry into the Sag10 Software; span length, initial tension at room temperature (20-25° C.). The following parameters are required for entry into the Sag10 Software to run the compressive stress calculation: built in Wire Stress, Wire Area (as fraction of total area), number of wire layers in the conductor, number of wire strands in the conductor, number of core strands, the stranding lay ratios of each wire layer. Stress-strain coefficients are required for input into the "SAG10" software as a Table (see Table 1, below).

TABLE 1

| Initial Wire | | | | | |
|---|---|---|---|---|---|
| A0 | A1 | A2 | A3 | A4 | AF |
| **Final Wire (10 year creep)** | | | | | |
| B0 | B1 | B2 | B3 | B4 | α (Al) |
| **Initial Core** | | | | | |
| C0 | C1 | C2 | C3 | C4 | CF |

TABLE 1-continued

| Final Core (10 year creep) | | | | | |
|---|---|---|---|---|---|
| D0 | D1 | D2 | D3 | D4 | α (core) |

Also a parameter TREF is specified which is the temperature at which the coefficients are referenced.

Definition of Stress Strain Curve Polynomials

First five numbers A0-A4 are coefficients of $4^{th}$ order polynomial that represents the initial wire curve times the area ratio:

$$\frac{A_{Wire}}{A_{total}} \cdot \sigma_{InitialWire} = A0 + A1\varepsilon + A2\varepsilon^2 + A3\varepsilon^3 + A4\varepsilon^4 \quad (2)$$

AF is the final modulus of the wire $$\frac{A_{Wire}}{A_{total}} \cdot \sigma_{FinalWire} = AF\varepsilon \quad (3)$$

Wherein ϵ is the conductor elongation in % and σ is the stress in psi

B0-B4 are coefficients of $4^{th}$ order polynomial that represents the final 10 year creep curve of the wire times the area ratio:

$$\frac{A_{Wire}}{A_{total}} \cdot \sigma_{FinalWire} = B0 + B1\varepsilon + B2\varepsilon^2 + B3\varepsilon^3 + B4\varepsilon^4 \quad (4)$$

C α (A1) is the coefficient of thermal expansion of the wire.

C0-C4 are coefficients of $4^{th}$ order polynomial that represents the initial curve times the area ratio for composite core only.

CF is the final modulus of the composite core

D0-D4 are coefficients of $4^{th}$ order polynomial that represents the final 10 year creep curve of the composite core times the area ratio α (core) is the coefficient of thermal expansion of the composite core.

In fitting the calculated and measured data, the best fit matches (i) the calculated curve to the measured data by varying the value of the stress parameter, such that the curves match at high temperatures (140-240° C.), and (ii) the inflection point (knee-point) of the measured curve closely matches the calculated curve, and (iii) the initial calculated sag is required to match the initial measured sag. The value of the stress parameter to gain the best fit to the measured data is thus derived. This result is the "Stress Parameter" for the cable.

Cable according to the present invention can be used in a variety of applications including in overhead electrical power transmission cables.

Advantages and embodiments of this invention are further illustrated by the following examples, but the particular materials and amounts thereof recited in these examples, as well as other conditions and details, should not be construed to unduly limit this invention. All parts and percentages are by weight unless otherwise indicated.

EXAMPLES

Illustrative Example

The wire for the Illustrative Example cable was prepared as follows. The wire was made using apparatus 60 shown in FIG. 6. Eleven (11) tows of 10,000 denier alpha alumina fiber (marketed by the 3M Company, St. Paul under the trade designation "NEXTEL 610") were supplied from supply spools 62, collimated into a circular bundle, and heat-cleaned by passing through 1.5 m (5 ft.) long alumina tube 63 heated to 1100° C. at 305 cm/min (120 in./min). Heat-cleaned fibers 61 were then evacuated in vacuum chamber 64 before entering crucible 67 containing melt (molten metal) 65 of metallic aluminum (99.99% Al) matrix material (obtained from Beck Aluminum Co., Pittsburgh, Pa.). The fibers were pulled from supply spools 62 by caterpuller 70. Ultrasonic probe 66 was positioned in melt 65 in the vicinity of the fiber to aid in infiltrating melt 65 into tows of fibers 61. The molten metal of wire 71 cooled and solidified after exiting crucible 67 through exit die 68, although some cooling likely occurred before the wire 71 fully exited crucible 67. Further, cooling of wire 71 was enhanced by streams of nitrogen gas delivered through cooling device 69 that impinged on wire 71. Wire 71 was collected onto spool 72.

Fibers 61 were evacuated before entering the melt 67. The pressure in the vacuum chamber was about 20 torr. Vacuum system 64 had a 25 cm long alumina entrance tube sized to match the diameter of the bundle of fiber 61. Vacuum chamber 64 was 21 cm long, and 10 cm in diameter. The capacity of the vacuum pump was 0.37 $m^3$/minute. The evacuated fibers 61 were inserted into the melt 65 through a tube on the vacuum system 64 that penetrated the metal bath (i.e., the evacuated fibers 61 were under vacuum when introduced into the melt 54. The inside diameter of the exit tube matched the diameter of the fiber bundle 61. A portion of the exit tube was immersed in the molten metal to a depth of 5 cm.

Infiltration of the molten metal 65 into the fibers 61 was enhanced by the use of a vibrating horn 66 positioned in the molten metal 65 so that it was in close proximity to the fibers 61. Horn 66 was driven to vibrate at 19.7 kHz and an amplitude in air of 0.18 mm (0.007 in.). The horn was connected to a titanium waveguide which, in turn, was connected to the ultrasonic transducer (obtained from Sonics & Materials, Danbury, Conn.).

The fibers 61 were within 2.5 mm of the horn tip. The horn tip was, made of a niobium alloy of composition 91 wt. % Nb-9 wt. % Mo (obtained from PMTI, Pittsburgh, Pa.). The alloy was fashioned into a cylinder 12.7 cm in length (5 in.) and 2.5 cm (1 in.) in diameter. The cylinder was tuned to the desired vibration frequency of 19.7 kHz by altering its length.

The molten metal 65 was degassed (e.g., reducing the amount of gas (e.g., hydrogen) dissolved in the molten metal) prior to infiltration. A portable rotary degassing unit available from Brummund Foundry Inc, Chicago, Ill., was used. The gas used was Argon, the Argon flow rate was 1050 liters per minute, the speed was provided by the air flow rate to the motor set at 50 liters per minute, and duration was 60 minutes.

The silicon nitride exit die 68 was configured to provide the desired wire diameter. The internal diameter of the exit die was 2.67 mm (0.105 in.).

The stranded core was stranded on stranding equipment at Wire Rope Company in Montreal, Canada. The cable had one wire in the center, and six wires in the first layer with a right hand lay. Prior to being helically wound together, the individual wires were provided on separate bobbins which were then placed in a motor driven carriage of the stranding equipment. The carriage held the six bobbins for the layer of the finished stranded cable. The wires of the layer were brought together at the exit of the carriage and arranged over the central wire. During the cable stranding process, the central wire, was pulled through the center of the carriage, with the carriage adding one layer to the stranded cable. The individual wires added as one layer were simultaneously pulled from their respective bobbins while being rotated about the central axis of the cable by the motor driven carriage. The result was a helically stranded core.

The stranded core was wrapped with adhesive tape using conventional taping equipment (model 300 Concentric Taping Head from Watson Machine International, Paterson, N.J.). The tape backing was aluminum foil tape with fiberglass, and had a pressure sensitive silicone adhesive (obtained under the trade designation "Foil/Glass Cloth Tape 363" from 3M Company, St. Paul, Minn.). The total thickness of tape 18 was 0.18 mm (0.0072 inch0). The tape was 1.90 cm (0.75 inch) wide.

The average diameter of the finished core was 8.23 mm (0.324 inch)) and the lay length of the stranded layer was 54.1 cm (21.3 inches).

The first trapezoidal aluminum alloy wires were prepared from aluminum/zirconium rod (9.53 mm (0.375 inch) diameter; obtained from Lamifil N.V., (Hemiksem, Belguim under the trade designation "ZTAL") with a tensile strength of 153.95 MPa (22,183 psi), an elongation of 13.3%, and an electrical conductivity of 60.4% IACS. The second trapezoidal wires were prepared from aluminum/zirconium rod of (9.53 mm (0.375 inch) diameter; "ZTAL") with a tensile strength of 132.32 MPa (19,191 psi)), an elongation of 10.4%, and an electrical conductivity of 60.5% IACS. The rods were drawn down at room temperature using five intermediate dies as is known in the art, and finally a trapezoidal shaped forming die. The drawing dies were made of tungsten carbide. The geometry of the tungsten carbide die had a 600 entrance angle, a 16-18° reduction angle, a bearing length 30% of the die diameter, and a 60° back relief angle. The die surface was highly polished. The die was lubricated and cooled using a drawing oil. The drawing system delivered the oil at a rate set in the range of 60-100 liters per minute per die, with the temperature set in the range of 40-50° C. The last forming die comprised two horizontal hardened steel (60 RC hardness) forming rolls, with highly polished working surfaces. The design of the roll grooves was based on the required trapezoidal profile. The rolls were installed on a rolling stand that was located between the drawbox and the outside drawblock. The final forming roll reduction, reduced the area of the wire about 23.5%. The amount of area reduction was sufficient to move the metal into the corners of the roll grooves and adequately fill the space between the forming rolls. The forming rolls were aligned and installed so that the cap of the trapezoidal wires faced the surfaces of the drawblock and the bobbin drum. After forming, the wire profile was checked and verified using a template.

This wire was then wound onto bobbins. Various properties of the resulting wire are listed in Table 2, below. The "effective diameter" of the trapezoidal shape refers to the diameter of a circle that has the same area as the cross-sectional area of the trapezoidal shape. There were 20 bobbins loaded into the stranding equipment (8 of the first wires for stranding the first inner layer), 12 of the second wires for stranding the second outer layer) and wire was taken from a subset of these for testing, which were the "sampled bobbins".

TABLE 2

| | Effective Diameter, mm (inch) | Tensile strength, MPa (psi) | Elongation, % | Conductivity, IACS % |
|---|---|---|---|---|
| Inner Layer | | | | |
| Wire 1st Bobbin | 4.54 (0.1788) | 168.92 (24,499) | 5.1 | 59.92 |
| Wire 4th Bobbin | 4.54 (0.1788) | 159.23 (23,095) | 4.3 | 60.09 |
| Wire 8th Bobbin | 4.54 (0.1788) | 163.39 (23,697) | 4.7 | 60.18 |
| Outer Layer | | | | |
| Wire 1st Bobbin | 4.70 (0.1851) | 188.32 (27,314) | 4.7 | 60.02 |
| Wire 4th Bobbin | 4.70 (0.1851) | 186.27 (27,016) | 4.3 | 60.09 |
| Wire 8th Bobbin | 4.70 (0.1851) | 184.73 (26,793) | 4.3 | 60.31 |
| Wire 12th Bobbin | 4.70 (0.1851) | 185.50 (26,905) | 4.7 | 59.96 |

A cable was made by Nexans, Weyburn, SK using a conventional planetary stranding machine and the core and (inner and outer) wires described above for Comparative Example. A schematic of the apparatus 80 for making cable is shown in FIGS. 7, 7A, and 7B.

Spool of core 81 was provided at the head of a conventional planetary stranding machine 80, wherein spool 81 was free to rotate, with tension capable of being applied via a braking system. The tension applied to the core during payoff was 45 kg (100 lbs.). The core was input at room temperature (about 23° C. (73° F.)). The core was threaded through the center of the bobbin carriages 82, 83, through closing dies 84, 85, around capstan wheels 86 and attached to conventional take-up (152 cm (60 in.) diameter) spool 87.

Prior to application of outer stranding layers 89, individual wires were provided on separate bobbins 88 which were placed in a number of motor driven carriages 82, 83 of the stranding equipment. The range of tension required to pull the wire 89 from the bobbins 88 was set to be in the range 11-14 kg (25-30 lbs.). Stranding stations consist of a carriage and a closing die. At each stranding station, wires 89 of each layer were brought together at the exit of each carriage at closing die 84, 85, respectively and arranged over the central wire or over the preceding layer, respectively. Thus, the core passed through two stranding stations. At the first station 8 wires were stranded over the core with a left lay. At the second station 12 wires were stranded over the previous layer with a right lay.

The core material and wires for a given layer were brought into contact via a closing die 84, 85, as applicable. The closing dies were cylinders (see FIGS. 7A and 7B) and were held in position using bolts. The dies were made of hardened tool steel, and were capable of being fully closed.

The finished cable was passed through capstan wheels 86, and ultimately wound onto (91 cm diameter (36 inch)) take-up spool 87. The finished cable was passed through a straightener device comprised of rollers (each roller being 12.5 cm (5 inches)), linearly arranged in two banks, with 7 rollers in each bank. The distance between the two banks of rollers was set so that the rollers just impinged on the cable. The two banks of rollers were positioned on opposing sides of the cable, with the rollers in one bank matching up with the spaces created by the opposing rollers in the other bank. Thus, the two banks were offset from each other. As the cable passed through the straightening device, the cable flexed back and forth over the rollers, allowing the strands in the conductor to stretch to the same length, thereby eliminating slack strands.

The inner layer consisted of 8 trapezoidal wires with an outside layer diameter of 15.4 mm (0.608 in.), a mass per unit length of 353 kg/km (237 lbs./kft.) with the left hand lay of 20.3 cm (8 in.). The closing blocks (made from hardened tool steel; 60 Rc hardness) for the inner layer were set at an internal diameter of 15.4 mm (0.608 in.). Thus the closing blocks were set at exactly the same diameter as the cable diameter.

The outer layer consisted of 12 trapezoidal wires with an outside layer diameter of 22.9 mm (0.9015 in.), a mass per unit length of 507.6 kg/km (341.2 lbs./kft) with the right hand lay of 25.9 cm (10.2 in.). The total mass per unit length of aluminum alloy wires was 928.8 kg/km 624.3 lbs./kft.), total mass per unit length of the core was 136.4 kg/km (91.7 lbs./kft.) and the total conductor mass per unit length was 1065 kg/km 716.0 lbs./kft.). The closing blocks (made from hardened tool steel; 60 Rc hardness) for the outer layer were set at an internal diameter of 22.9 mm (0.9015 in.). Thus the closing blocks were set at exactly the same diameter as the final cable diameter.

The inner wire and outer wire tension (as pay-off bobbins) was measured using a hand held force gauge (available McMaster-Card, Chicago, Ill.) and set to be in the range of 13.5-15 kg (29-33 lbs.) and the core pay-off tension was set by brake using the same measurement method as the bobbins at about 90 kg (198 lbs.). Further, no straightener was used, and the cable was not spooled but left to run straight and to lay out on the floor.

The core was input at room temperature (about 23° C. (73° F.)).

The stranding machine was run at 15 m/min. (49 ft/min.), driven using conventional capstan wheels, a standard straightening device, and a conventional 152 cm (60 in.) diameter take-up spool.

The resulting conductor was tested using the following "Cut-end Test Method". A section of conductor to be tested was laid out straight on the floor, and a sub-section 3.1-4.6 m (10-15 ft.) long was clamped at both ends. The conductor was then cut to isolate the section, still clamped at both ends. One clamp was then released and no layer movement was observed. The section of conductor was then inspected for movement of layers relative to each other. The movement of each layer was measured using a ruler to determine the amount of movement relative to the core. The outer aluminum layers retracted relative to the composite core; taking the core as the zero reference position, the inner aluminum layer retracted 0.16 in. (4 mm) and the outer layer retracted 0.31 in. (8 mm).

The Illustrative Example cable was also evaluated by Kinectrics, Inc. Toronto, Ontario, Canada using the following "Sag Test Method I". A length of conductor was terminated with conventional epoxy fittings, ensuring the layers substantially retain the same relative positions as in the as manufactured state, except the aluminum/zirconium wires were extended through the epoxy fittings and out the other side, and then reconstituted to allow for connection to electrical AC power using conventional terminal connectors. The epoxy fittings were poured in aluminum spelter sockets that were connected to turnbuckles for holding tension. On one side, a load cell was connected (5000 kilograms (kg) capacity) to a turnbuckle and then at both ends the turnbuckles were attached to pulling eyes. The eyes were connected to large concrete pillars, large enough to minimize end deflections of the system when under tension. For the test, the tension was pulled to 20% of the conductor rated breaking strength. Thus 2082 kg (4590 lb) was applied to the cable. The temperature was measured at three locations along the length of the conductor (at ¼, ½ and ¾ of the distance of the total (pulling-eye to pulling-eye) span) using nine thermocouples (three at each location; J-type available from Omega Corporation, Stamford, Conn.). At each location, the three thermocouples were positioned in three different radial positions within the conductor; between the outer aluminum strands, between the inner aluminum strands, and adjacent to (i.e., contacting) the outer core wires. The sag values were measured at three locations along the length of the conductor (at ¼, ½ and ¾ of the distance of the span) using pull wire potentiometers (available from SpaceAge Control, Inc, Palmdale, Calif.). These were positioned to measure the vertical movement of the three locations. AC current was applied to the conductor to increase the temperature to the desired value. The temperature of the conductor was raised from room temperature (about 20° C. (68° F.)) to about 240° C. (464° F.) at a rate in the range of 60-120° C./minute (140-248° F./minute). The highest temperature of all of the thermocouples was used as the control. About 1200 amps was required to achieve 240° C. (464° F.).

The sag value of the conductor ($Sag_{total}$) was calculated at various temperatures using the following equation:

$$Sag_{total} = Sag_{1/2} - \left(\frac{Sag_{1/4} + Sag_{3/4}}{2}\right)$$

Where:

$Sag_{1/2}$=sag measured at ½ the distance of the span of the conductor $Sag_{1/4}$=sag measured at ¼ the distance of the span of the conductor $Sag_{3/4}$=sag measured at ¾ the distance of the span of the conductor Table 3 (below) summarizes the fixed input test parameters.

TABLE 3

| Parameter | Value |
|---|---|
| Total span length | 68.6 m (225 ft.) |
| Effective span length* - m (ft.) | 65.5 m (215 ft.) |
| Height of North fixed point | 2.36 m (93.06 in.) |
| Height of South fixed point | 2.47 m (97.25 in.) |
| Conductor weight | 1.083 kg/m (0.726 lbs./ft.) |
| Initial Tension (@ 20% RTS) | 2082 kg (4590 lb) |
| Load cell capacity | 5000 kg (1100 lbs) load cell |

Figure 8:
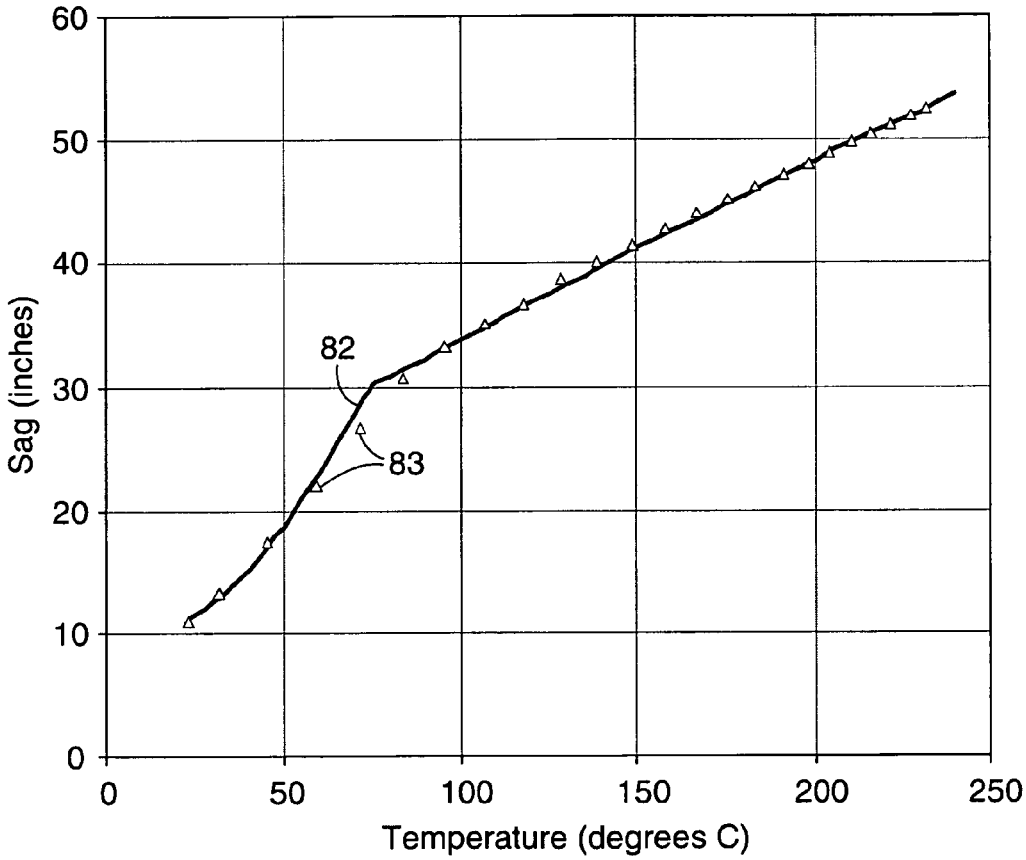
FIG. 8 is a plot of cable sag data for the Illustrative Example.

The resulting sag and temperature data ("Resulting Data" for Illustrative Example) was plotted and then a calculated curve was fit using the Alcoa Sag10 graphic method available in a software program from Alcoa Fujikura Ltd., Greenville, S.C. under the trade designation "SAG10" (version 3.0 update 3.9.7). The stress parameter was a fitting parameter in "SAG10" labeled as the "built-in aluminum stress" which adjusted the position of the knee-point on the predicted graph and also the amount of sag in the high temperature, post-knee-point regime. A description of the stress parameter theory was provided in the Alcoa Sag10 Users Manual (Version 2.0): Theory of Compressive Stress in Aluminum of ACSR, the disclosure of which is incorporated herein by reference. The conductor parameters for the 675 kcmil cable as shown Tables 4-7 (below) were entered into the Sag10 Software. The best fit matched (i) the calculated curve to the "resulting data" by varying the value of the stress parameter, such that the curves matched at high temperatures (140-240° C.), and (ii) the inflection point (knee-point) of the "resulting data" curve closely matched the calculated curve, and (iii) the initial calculated sag was required to match the initial "resulting data" sag (i.e. initial tension at 22° C. (72° F.) is 2082 kg, producing 27.7 cm (10.9 inches) of sag.). For this example, the value of 3.5 MPa (500 psi) for the stress parameter provided the best fit to the "resulting data". FIG. 8 shows the sag calculated by Sag10 (line 82) and the measured Sag (plotted data 83).

The following the conductor data were input into the "SAG10" software:

TABLE 4

| CONDUCTOR PARAMETERS IN SAG10 | |
|---|---|
| Area | 381.6 $mm^2$ (0.5915 $in^2$) |
| Diameter | 2.3 cm (0.902 in) |
| Weight | 1.083 kg/m (0.726 lb./ft.) |
| RTS: | 10,160 kg (22,400 lbs.) |

TABLE 5

| LINE LOADING CONDITIONS | |
|---|---|
| Span Length | 65.5 m (215 ft.) |
| Initial Tension (at 22° C. (72° F.)) | 2082 kg (4,590 lbs.) |

TABLE 6

| OPTIONS FOR COMPRESSIVE STRESS CALCULATION | |
|---|---|
| Built in Aluminum Stress | (3.5 MPa (500 psi) |
| Aluminum Area (as fraction of total area) | 0.8975 |
| Number of Aluminum Layers: | 2 |
| Number of Aluminum Strands | 20 |
| Number of Core Strands | 7 |
| Stranding Lay Ratios | |
| Outer Layer | 11 |
| Inner Layer | 13 |

Stress Strain Parameters for Sag10; TREF=22 C.° (71° F.)

Input of the software run (see Table 7, below)

TABLE 87

| Initial Aluminum | | | | | |
|---|---|---|---|---|---|
| A0 | A1 | A2 | A3 | A4 | AF |
| 17.7 | 56350.5 | −10910.9 | −155423 | 173179.9 | 79173.1 |
| Final Aluminum (10 year creep) | | | | | |
| B0 | B1 | B2 | B3 | B4 | α (Al) |
| 0 | 27095.1 | −3521.1 | 141800.8 | −304875.5 | 0.00128 |
| Initial Core | | | | | |
| C0 | C1 | C2 | C3 | C4 | CF |
| −95.9 | 38999.8 | −40433.3 | 87924.5 | −62612.9 | 33746.7 |
| Final Core (10 year creep) | | | | | |
| D0 | D1 | D2 | D3 | D4 | α (core) |
| −95.9 | 38999.8 | −40433.3 | 87924.5 | −62612.9 | 0.000353 |

Definition of Stress Strain Curve Polynomials

First five numbers A0-A4 are coefficients of $4^{th}$ order polynomial that represents the initial aluminum curve times the area ratio:

$$\frac{A_{Wire}}{A_{total}} \cdot \sigma_{InitialWire} = A0 + A1\varepsilon + A2\varepsilon^2 + A3\varepsilon^3 + A4\varepsilon^4$$

AF is the final modulus of aluminum $$\frac{A_{Wire}}{A_{total}} \cdot \sigma_{FinalWire} = AF\varepsilon$$

Wherein ε is the conductor elongation in % and σ is the stress in psi

B0-B4 are coefficients of $4^{th}$ order polynomial that represents the final 10 year creep curve of the aluminum times the area ratio:

$$\frac{A_{Wire}}{A_{total}} \cdot \sigma_{FinalWire} = B0 + B1\varepsilon + B2\varepsilon^2 + B3\varepsilon^3 + B4\varepsilon^4$$

C α (A1) is the coefficient of thermal expansion of aluminum.

C0-C4 are coefficients of $4^{th}$ order polynomial that represents the initial curve times the area ratio for composite core only.

CF is the final modulus of the composite core

D0-D4 are coefficients of $4^{th}$ order polynomial that represents the final 10 year creep curve of the composite core times the area ratio α (core) is the coefficient of thermal expansion of the composite core.

Prophetic Example 1

A cable would be made as described in Illustrative Example 1 with the following changes to the stranding process. Referring to FIG. 7, a second capstan 86A would be added between payoff reel 81 and carriage 82. The tension between the second capstan 86A and carriage 82 would be set to 240 kg (530 lbs.) using the tension control mechanisms of the capstans in order to produce a cable with a stress parameter of about −3.5 MPa (−500 psi).

The cable would be wrapped with adhesive tape using conventional taping equipment (model 300 Concentric Taping Head from Watson Machine International, Paterson, N.J.). Referring again to FIG. 7, taping equipment 95 would be located between the final closing die 85 and capstan 86. The tape backing would be aluminum foil tape with fiberglass, and have a pressure sensitive silicone adhesive (available under the trade designation "Foil/Glass Cloth Tape 363" from 3M Company, St. Paul, Minn.). The total thickness of tape 18 would 0.18 mm (0.0072 inch). The tape would be 1.90 cm (0.75 inch) wide.

Prophetic Example 2

A cable would be made as described in Prophetic Example 1 with the following changes to the stranding process. The tension between the second capstan 86A and carriage 82 would be set to 1202 kg (2650 lbs.) using the tension control mechanisms of the capstans in order to produce a cable with a stress parameter of about −34 MPa (−5000 psi).

Prophetic Example 3

A cable would be made as described in Illustrative Example 1 with the following changes to the stranding process. The core would be provided on a steel spool and placed in an oven for 8 hours to ensure the core temperature reaches 44° C. above the ambient air temperature around the stranding equipment (e.g., if the ambient temperature was 24° C., the core would reach a temperature in the oven of 68° C.). The spool would then removed and placed on pay-off spool 81 (see FIG. 7, with all features shown) of stranding machine 80, again ensuring that at the start of the stranding run the core was still at the elevated temperature (since a spool is large, the core does not loose heat quickly; however, the stranding run should be done within about 2 hours of the spool being removed from the furnace). Further the wires on the payoff spools that form the outer layers on the cable, should be at the ambient temperature (e.g. 24° C.). This process would provide a cable with a stress parameter of −3.5 MPa (−500 psi).

Prophetic Example 4

A cable would be made as described in Prophetic Example 3 with the following change to the stranding process. The temperature of the core at the start of the stranding run would be 131° C. above the ambient air temperature. Thus for an ambient temperature of 24° C., the core would be 155° C. This process would provide a cable with a stress parameter of −17 MPa (−2500 psi).

Prophetic Example 5

A cable would be made as described in Prophetic Example 3 with the following change to the stranding process. The temperature of the core at the start of the stranding run would be 239° C. above the ambient air temperature. Thus for an ambient temperature of 24° C., the core would be 263° C. This process would provide a cable with a stress parameter of −34 MPa (−5000 psi).

Figure 9:
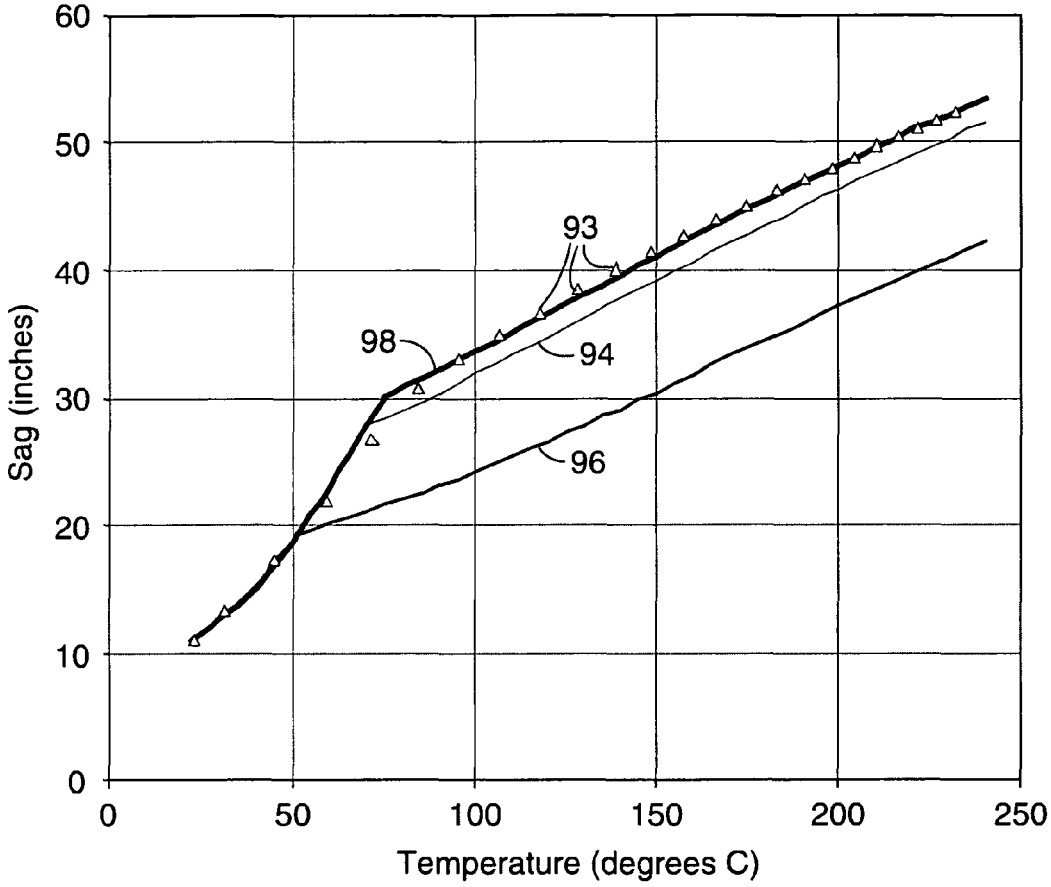
FIG. 9 is a plot of cable sag data for the Illustrative Example and Prophetic Example 1.

Calculations of Sag for Prophetic Examples 1-5 and Comparison to Illustrative Example The Alcoa Sag10 Graphic Method model described in the Illustrative Example is utilized to predict the sag vs temperature behavior of cables described in Prophetic Examples 1 and 2. Sag curves were generated using the Sag10 model and method of the Illustrative Example. The conductor parameters are shown in Tables 8-11 were entered into the Sag10 Software. The values for the compressive stress parameter were −3.5 MPa (−500 psi) and −34 MPa (−5000 psi). FIG. 9 shows the sag vs temperature curves of the Illustrative Example and Prophetic Examples 1, 2, 3, and 5. The measured data of the Illustrative Example is shown as plotted data 93 and the calculated curve of the Illustrative Example is shown as line 98. The calculated curves for Prophetic Examples 1 and 3 which used a stress parameter of −3.5 MPa (−500 psi) is shown as line 94. The calculated curve for Prophetic Examples 2 and 5 which used a stress parameter of −34 MPa (−5000 psi) is shown as line 96.

The following the conductor data were input into the "SAG10" software:

TABLE 8

| CONDUCTOR PARAMETERS IN SAG10 | |
|---|---|
| Area | 381.6 $mm^2$ (0.5915 $in^2$) |
| Diameter | 2.3 cm (0.902 in.) |
| Weight | 1.083 kg/m (0.726 lb/ft.) |
| RTS: | 10,160 kg (22,400 lbs.) |

TABLE 9

| LINE LOADING CONDITIONS | |
|---|---|
| Span Length | 65.5 m (215 ft.) |
| Initial Tension (at 22° C. (72° F.)) | 2082 kg (4,590 lbs.) |

TABLE 10

| OPTIONS FOR COMPRESSIVE STRESS CALCULATION | |
|---|---|
| Built in Aluminum Stress Values | +500 (fit to measured data).<br>−500 (Prophetic Example 1)<br>−5000 (Prophetic Example 2) |
| Aluminum Area (as fraction of total area) | 0.8975 |
| Number of Aluminum Layers: | 2 |
| Number of Aluminum Strands | 20 |
| Number of Core Strands | 7 |
| Stranding Lay Ratios | |
| Outer Layer | 11 |
| Inner Layer | 13 |

Stress Strain Parameters for Sag10; TREF = 22° C. (71° F.)

Input Parameters of the software run (see Table 11, below)

TABLE 11

| Initial Aluminum | | | | | |
|---|---|---|---|---|---|
| A0 | A1 | A2 | A3 | A4 | AF |
| 17.7 | 56350.5 | −10910.9 | −155423 | 173179.9 | 79173.1 |
| Final Aluminum (10 year creep) | | | | | |
| B0 | B1 | B2 | B3 | B4 | α (Al) |
| 0 | 27095.1 | −3521.1 | 141800.8 | −304875.5 | 0.00128 |
| Initial Core | | | | | |
| C0 | C1 | C2 | C3 | C4 | CF |
| −95.9 | 38999.8 | −40433.3 | 87924.5 | −62612.9 | 33746.7 |
| Final Core (10 year creep) | | | | | |
| D0 | D1 | D2 | D3 | D4 | α (core) |
| −95.9 | 38999.8 | −40433.3 | 87924.5 | −62612.9 | 0.000353 |

Comparative Example 1

A 70 meter (230 feet) sample of a steel reinforced cable ("Steel Reinforced ACSR Cable (3/0 ACSR 6/1 PIGEON" was obtained from King Wire Inc, Number One Cable Place, North Chicago, Ill. The sample had the specifications in Table 12, below.

TABLE 12

| | |
|---|---|
| Code Word | 3/0 ACSR 6/1 PIGEON BARE AL |
| Size (AWG) | 3/0 |
| Stranding ACSR (Al/Stl) | 6/1 |
| Diameter Aluminum Wires | 4.2 mm (0.1672 in.) |
| Diameter Individual Steel Wire | 4.2 mm (0.1672 in.) |
| Diameter Complete Cable OD | 12.8 mm (0.502 in.) |
| Area | |
| Area Aluminum | 85 $mm^2$ (0.1317 $in.^2$) |
| Area Steel | 14.2 $mm^2$ (0.0220 $in^2$) |
| Total Area | 99.2 $mm^2$ (0.1537 $in.^2$) |

TABLE 12-continued

| | |
|---|---|
| Weight | 0.353 kg/m (0.237 lbs/ft. |
| Breaking Strength | 3003 kg (6620 lbs.) |

Example 1

A 45.7 cm (18 inch length of the cable in Comparative Example 1 was modified in the following manner order to obtain a negative aluminum pre-stress. The aluminum wires were removed from 7.6 cm (3 inches) on either side, leaving the central core wire exposed. About 2.5 cm (1 inch) of the ends of the central core wire were threaded using a #10 die with 13 threads per cm (32 threads per inch). Spacers were added to fill in the gap between the threaded section and the aluminum wires on the sample. #10 coupling nuts with 13 threads per cm (32 threads per inch) were screwed onto the threaded steel core wire to be snug with the spacers. The sample was hand wrapped tightly with a 2.5 cm (1 inch) wide fiber reinforced packaging tape available from 3M Company St. Paul, Minn. under the trade designation "SCOTCH 898". The tape was overlapped by approximately ¼ of its width. One coupling nut was held fixed in a vise and the other nut was tightened to a torque of 0.29 kilogram force-meter (25 inch-pounds) using a torque wrench. The diameter of the taped cable upon completion of the tensioning of the steel was measured to be 13.7 mm cm (0.54 inch). The aluminum wires remained tightly wrapped about the central core wire. No looseness of aluminum wires was observed. No gap was observed between the aluminum wires and the central core wire. The aluminum wires did not birdcage or expand away from the central core wire.

To calculate the compressive stress produced in the aluminum, the tension in the steel core wire was calculated from the torque value using data in the Krone Socket Screw Selector (available from Holo-Krome Company, West Hartford, Conn.). For the #10 screw a torque of 1.4 kilogram-force meter (120 inch-pounds) would produce a tensile load of 1270 (2800 lbs.) in a threaded steel wire. The tensile load produced in the steel core wire by tightening to 0.29 kilogram force-meter (25 inch-lbs.) is calculated to be 264 kg (583 lbs.; 25/120*2800 lbs). The tensile load in the steel is considered equal and opposite to an equivalent compressive load in the aluminum. Thus the aluminum is calculated to experience a compressive load of −264 kg (−583 lbs.). From this, the compressive stress in the aluminum is calculated to be −30.5 MPa (−4425 psi; 583 lbs./1317 $in^2$).

Calculations of Sag for Comparative Examples 1 and Example 1

Figure 10:
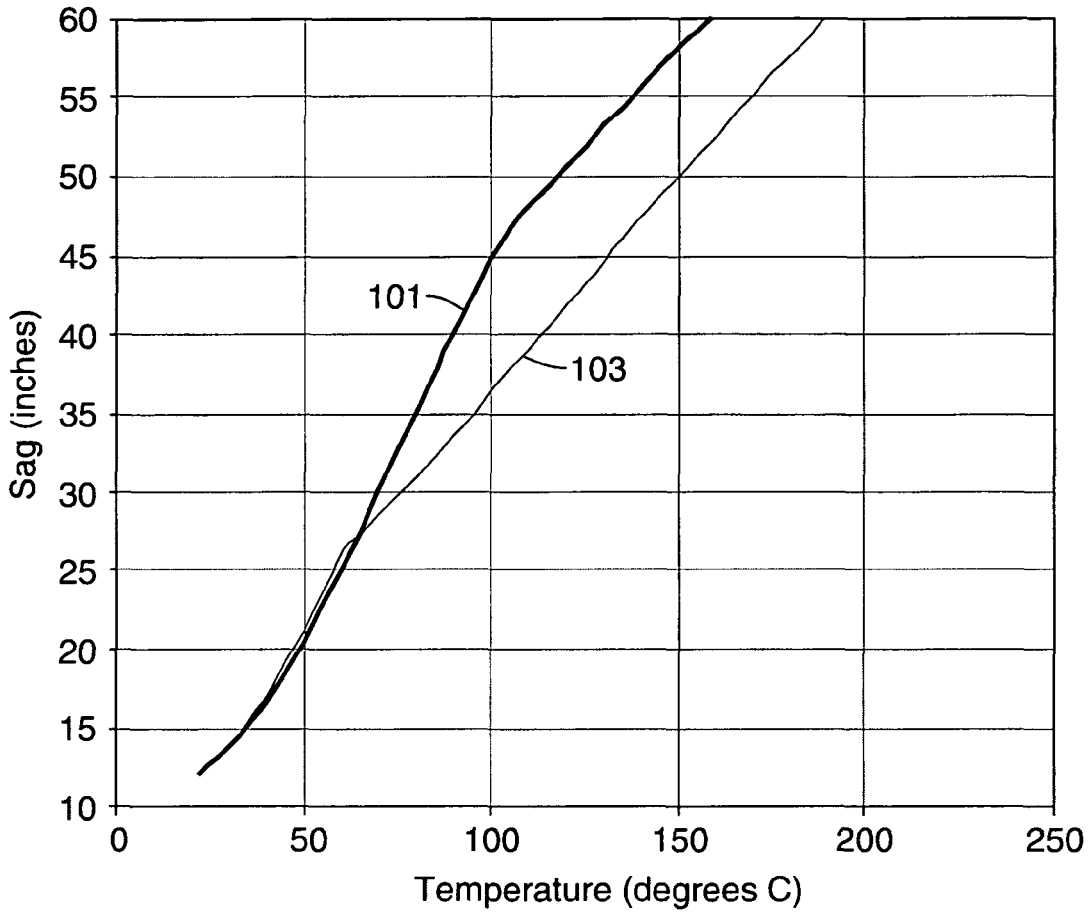
FIG. 10 is a plot of cable sag data for the Comparative Example and Example 1.
Figure 11:
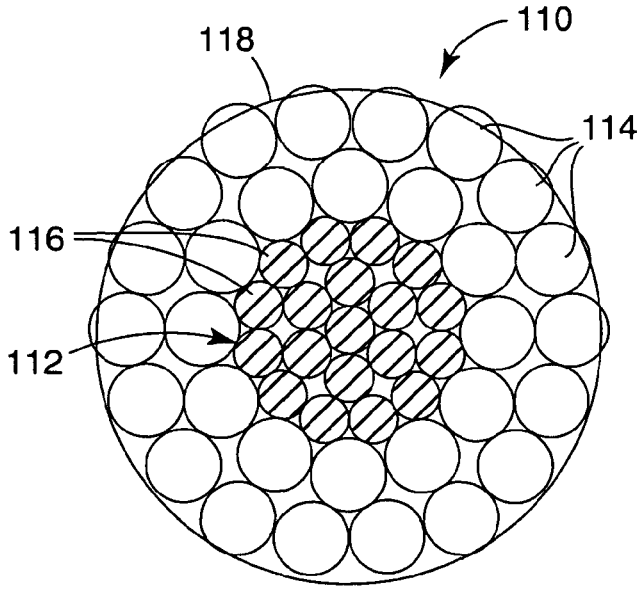
FIG. 11 is schematic, cross-sectional view of exemplary embodiment of a cable in accordance with the present invention

Refer to Tables 13-15, the calculated sag vs temperature characteristics of the cable as described in Example 1 was compared to the calculated sag vs temperature characteristics of the cable as described in Comparative Example 1. The Alcoa Sag10 software model previously described in Illustrative Example 1 was utilized to determine the sag vs temperature behavior of the cable in Comparative Example 1 using a positive stress parameter value of 17.2 MPa (2500 psi). Similarly, the Alcoa Sag10 software model was utilized to determine the sag vs temperature behavior of a length of cable of Example 1 that had an aluminum pre-stress of −30.5 (−4425 psi). Sag vs temperature curves were generated using the same 65.5 m (215 ft.) span length parameter of Example 1. The initial tension in the modeled cables was 20% of breaking strength. Line 101 of FIG. 10 shows the curve calculated for values of +17.2 MPa (+2500 psi) for the Comparative Example cable. Line 103 of FIG. 10 shows the curve calculated for values of −30.5 MPa (−4425 psi) for the Example 1 cable.

The following the conductor data were input into the "SAG10" software:

TABLE 13

CONDUCTOR PARAMETERS IN SAG10

| Codeword | Pigeon |
|---|---|
| Area | 99.3 $mm^2$ (0.1537 $in^2$) |
| Diameter | 12.8 cm (0.502 in.) |
| Weight | 0.353 kg/m (0.231 lb/ft.) |
| RTS: | 3003 kg (6,620 lbs.) |
| Stress Strain Chart | 1–938 |

TABLE 14

LINE LOADING CONDITIONS

| | |
|---|---|
| Span Length | 65.5 m (215 ft.) |
| Initial Tension (at 22° C. (72° F.)) | 600 kg (1324 lbs.) |

TABLE 15

OPTIONS FOR COMPRESSIVE STRESS CALCULATION

| | |
|---|---|
| Built in Aluminum Stress Values | 17.2 MPa (2500 psi) (Example 2)<br>−30.5 MPa (−4425 psi) (Example 3) |
| Aluminum Area (fraction of total area) | 0.857 |
| Number of Aluminum Layers: | 1 |
| Number of Aluminum Strands | 6 |
| Number of Core Strands | 1 |
| Stranding Lay Ratio Outer Layer | 13 |

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A cable, comprising:

a longitudinal core having a thermal expansion coefficient; and a plurality of wires collectively having a thermal expansion coefficient greater than the thermal expansion coefficient of the core, wherein the plurality of wires comprise at least one of aluminum wires, copper wires, aluminum alloy wires, or copper alloy wires, and wherein the plurality of wires are stranded around the core, and wherein the cable has a stress parameter less than 0 MPa; and wherein the wires are helically stranded to have a lay factor of from 10 to 150.

2. The cable according to claim 1, wherein the core comprises composite comprising continuous fibers of at least one of the aramid, ceramic, boron, poly(p-phenylene-2,6-benzobisoxazole), graphite, carbon, titanium, tungsten, or shape memory alloy in a polymeric matrix.

3. The cable according to claim 1, wherein the core comprises composite comprising continuous ceramic in a polymeric matrix.

4. The cable according to claim 1, wherein the core comprises wires having a diameter from 1 mm to 12 mm.

5. The cable according to claim 1, wherein the wires are trapezoidal in shape.

6. The cable according to claim 1, wherein the core comprises at least one solid metal wire.

7. The cable according to claim 6, wherein the at least one solid metal wire is at least one of steel, titanium, tungsten, or a shape memory alloy.

8. The cable according to claim 6, wherein the at least one solid metal wire has a diameter from 1 mm to 4 mm.

9. The cable according to claim 6, wherein the at least one solid metal wire comprises steel.

10. The cable according to claim 6, wherein the at least one solid metal wire is positioned within the cable such that it is a central core wire.

11. The cable according to claim 6, wherein the at least one solid metal wire is positioned within the cable such that it is a central core wire.

* * * * *

UNITED STATES PATENT AND TRADEMARK OFFICE

CERTIFICATE OF CORRECTION

PATENT NO. : 8,653,370 B2
APPLICATION NO. : 11/318368
DATED : February 18, 2014
INVENTOR(S) : Douglas E. Johnson et al.

It is certified that error appears in the above-identified patent and that said Letters Patent is hereby corrected as shown below:

In the Specification

Column 2
Lines 50-51, delete "invention" and insert -- invention. --, therefor.

Column 4
Line 1, delete "and or" and insert -- and/or --, therefor.

Line 7, delete "and or" and insert -- and/or --, therefor.

Column 5
Line 6, delete "GPa" and insert -- GPa. --, therefor.

Lines 16-17, delete "and or" and insert -- and/or --, therefor.

Line 62, delete "and or" and insert -- and/or --, therefor.

Column 6
Line 11, delete "and or" and insert -- and/or --, therefor.

Line 20, delete "and or" and insert -- and/or --, therefor.

Column 11
Line 31, delete "and or" and insert -- and/or --, therefor.

Column 13
Lines 46-47, delete "tumbuckles" and insert -- turnbuckles --, therefor.

Signed and Sealed this
Second Day of September, 2014

Michelle K. Lee

Michelle K. Lee
*Deputy Director of the United States Patent and Trademark Office*

Column 16
Line 55, delete “Brummund” and insert -- Brumund --, therefor.

Column 17
Line 26, delete “Belguim” and insert -- Belgium --, therefor.

Column 21
Line 38 (Approx.), delete “22 C.°” and insert -- 22° C. --, therefor.

Column 24
Line 64, delete “$in^2$” and insert -- $in.^2$ --, therefor.